US012029309B1

(12) United States Patent
Kassenaar Edge et al.

(10) Patent No.: US 12,029,309 B1
(45) Date of Patent: Jul. 9, 2024

(54) MULTIFUNCTIONAL SUN PROTECTION ARTICLES AND METHODS

(71) Applicant: Snap Design LLC, Brookline, MA (US)

(72) Inventors: Anne Judith Kassenaar Edge, Brookline, MA (US); Paul Michael Ginandes, Dorchester, MA (US)

(73) Assignee: Snap Design LLC, Brookline, MA (US)

( * ) Notice: Subject to any disclaimer, the term of this patent is extended or adjusted under 35 U.S.C. 154(b) by 507 days.

(21) Appl. No.: 17/200,737

(22) Filed: Mar. 12, 2021

Related U.S. Application Data

(60) Provisional application No. 62/988,911, filed on Mar. 12, 2020.

(51) Int. Cl.
*A45F 4/14* (2006.01)
*A41D 3/08* (2006.01)
*A45F 4/04* (2006.01)

(52) U.S. Cl.
CPC ..... *A45F 4/14* (2013.01); *A41D 3/08* (2013.01); *A45F 4/04* (2013.01)

(58) Field of Classification Search
CPC ..... E04H 15/30; A45F 4/14
See application file for complete search history.

(56) References Cited

U.S. PATENT DOCUMENTS 929,357 A * 7/1909 Whitney ..... E04H 15/30 5/413 R
1,089,103 A * 3/1914 Barnard ..... E04H 15/30 160/354
2,268,317 A * 12/1941 Till ..... A45F 4/14 2/89
3,060,949 A 10/1962 Moss
3,837,006 A * 9/1974 Laseman ..... A45F 4/14 2/69.5

(Continued)

FOREIGN PATENT DOCUMENTS

FR 475017 A * 4/1915

OTHER PUBLICATIONS

Rein, Diode Fibres for Fabric-Based Optical Communications, Nature, Aug. 9, 2018, 214-220, vol. 560, Springer Nature Limited, Berlin/Heidelberg, Germany, downloaded Feb. 27, 2020.

(Continued)

*Primary Examiner* — Noah Chandler Hawk
(74) *Attorney, Agent, or Firm* — Maura K. Moran; Cambridge Technology Law LLC

(57) ABSTRACT

A multi-functional article provides protection from sun/wind exposure when worn as a garment or when converted into a shelter structure. The article may have a stretchy rear panel, side panels, a peak for receiving a pole for supporting the assembled shelter and that lays flat when the article is a garment, and a rear pocket to hold items in the shelter or serve as a collar for the garment or a bag for storing the article when it is not in use. The article may also have a top strap for use as a garment belt or for securing the article to the ground when the article is a shelter, and bottom tiedown straps for shortening side panels when the article is a garment or for securing the article to the ground when the article is a shelter. Multiple articles may be linked together to form a larger shelter.

30 Claims, 17 Drawing Sheets

(56) References Cited

U.S. PATENT DOCUMENTS

| | | | | |
|---|---|---|---|---|
| 4,594,735 | A * | 6/1986 | Rolf | E04H 15/30 2/89 |
| 5,769,106 | A * | 6/1998 | Achuff | A45F 4/02 135/97 |
| 5,918,614 | A | 7/1999 | Lynch | |
| 2011/0179548 | A1* | 7/2011 | Weston | A45F 4/14 2/84 |
| 2018/0242662 | A1 | 8/2018 | Luna | |

OTHER PUBLICATIONS

Hatch, Garments as Solar Ultraviolet Radiation Screening Materials, Dermatolagi Clinics, 24, 2006, 85-100, Elsevier Inc., Amsterdam, Netherlands https://ag.arizona.edu/research/uv-protective-clothing/overview.pdf, downloaded Feb. 27, 2020.

Adams, Specialty Textiles: Spacer Mesh, 7 pp., Jason Mills LLC, Milltown, NJ blog entry uploaded Jan. 7, 2014 on https://www.jasonmills.com/blog/specialty-textiles-spacer-mesh/, downloaded Mar. 8, 2021.

Content in Pre Mar. 12, 2019, Zinnia Sunscreens Website, 22 pp., Zinnia https://www.zinniasunscreens.com (now https://www.zinniasunshades.com), uploaded pre-Mar. 12, 2019, downloaded May 18, 2021 and Jun. 2, 2021, from https://aj-kassenaar-7yce.squarespace.com/.

Moran, Statement Regarding Content In Pre Mar. 12, 2019, Zinnia Sunscreens Website, Jun. 12, 2021, 3 pp.

* cited by examiner

MULTIFUNCTIONAL SUN PROTECTION ARTICLES AND METHODS

CROSS-REFERENCE TO RELATED APPLICATION

This application claims the benefit at least in part of the filing date of U.S. Patent Application 62/988,911, for MULTIFUNCTIONAL SUN PROTECTION ARTICLES AND METHODS, filed Mar. 12, 2020, the entire disclosure of which is hereby incorporated by reference.

FIELD

The present invention relates to the field of weather protection and particularly to the fields of multi-functional sun/wind protection systems, wearable weather protection, and temporary sheltering structures.

BACKGROUND

This invention relates to methods and systems for providing protection from sun and other weather exposure.

Protection from sun exposure is increasingly necessary to prevent overexposure to damaging ultraviolet rays from the sun. There are many systems that have been developed to provide protection from sun exposure. For example, shelters for the beach or in the park, particularly those that may be temporarily assembled, are increasingly used to provide shade from the sun and other elements. Umbrellas are frequently used, but umbrellas can be cumbersome, fragile and susceptible to wind damage. Existing shade tents are typically compression-based structures with floors and pole assemblies, but they can be heavy and cumbersome to transport, and are frequently complicated to assemble and disassemble. In addition, they prevent a user from sitting directly on the ground/sand and enjoying the view.

Garments consisting of loose layers of fabric have been worn on the body, head and face to shield people from sun and heat for millennia. Tribal and traditional garb used in many cultures reflects the practicality of having an accessible protective layer to guard against ultraviolet light that can damage the skin. However, on an outing, it may not be convenient or desirable to always wear so many layers of protection during an outing.

Together, such conventional sun protection systems may provide a desired level of sun protection. However, most such systems provide protection in one or few functional modes, so that it becomes necessary for a person to carry multiple sun protection systems and devices for a single outing, such as to a beach or park. It can be bulky and heavy to transport multiple systems, and temporary use of an item can lead to loss, as it might be left behind accidentally at the end of the outing.

It is desirable to have a simple, efficient sun multi-functional protection system or device that can prevent overexposure to the sun in multiple use modes. It is desirable to have a simple, efficient sun protection system or device that can serve as a garment and a shelter structure. It is further desirable to provide a shelter structure that is conveniently convertible into and from a garment. It is further desirable to provide a fashionable garment that is conveniently convertible into and from a shelter structure for protection from sun and other weather exposure.

SUMMARY

A multi-functional article is herein disclosed for protection of at least one individual from at least one weather element. The article may be worn as a garment and be convertible into a shelter structure, both the garment and the structure providing protection from sun and wind exposure. The article may provide protection from sun and wind exposure when worn as a garment or converted into a shelter structure. The article may have a rear panel formed from a stretchy material, side panels, a peak for receiving a supporting pole for holding the shelter up from the ground, a hood, a rear pocket to hold items in the shelter, to be a collar for the garment, and to invert into a pocket for storing the article when it is not in use. The article may also have slits to act as sleeves or armholes, a top strap to operate as a belt or to secure the article to the ground when the article is erected into the shelter, and bottom straps to shorten the side panels when the article is a garment and to secure the article to the ground when the article is a shelter.

In more detail, the article may have a bottom edge and a top edge, a rear panel formed from a stretchy material and extending from the bottom edge to the top edge. The article also may have a pair of side panels extending from the bottom edge to the top edge, with a first side panel having a first side panel attached edge, which may be attached to a first side edge of the rear panel, and a first side panel front edge opposite to the first side panel attached edge. The first side panel front edge may extend from the top edge of the article to the bottom edge of the article, and the first side panel may have a first side panel front bottom corner disposed between the first side panel front edge and the bottom edge of the article.

The second side panel may have a second side panel attached edge, which may be attached to the second side edge of the rear panel, and a second side panel front edge opposite to the second side panel attached edge. The second side panel front edge may extend from the top edge of the article to the bottom edge of the article, and the second side panel may have a second side panel front bottom corner disposed between the second side panel front edge and the bottom edge of the article.

The rear panel and the side panels of the article may operate as the body of the structure when the article is formed into a shelter, with the rear panel serving as the structure top, the side panels serving as side curtains, and the article's top and bottom straps serving to secure the structure to the ground and, along with retaining poles, to exert tensioning forces on the structure to maintain the structural integrity of the shelter.

A peak may be disposed on the article near or along the bottom edge. The peak may have a gusset and a cushioned socket formed from a second stretchy material and arranged to receive a pole for holding the article up from the ground when the article is assembled into a shelter for at least one individual, and also arranged to lay flat on an interior surface of a garment when the article is worn as the garment.

In certain embodiments, the article may also have a hood attached to the top edge of the article and sized to contain an individual's head.

The article may also have a rear pocket sized and arranged to hold items when the article is erected into a shelter, and to serve as a collar when the article is worn as a garment. The rear pocket may be invertible and arranged to contain the article for storage thereof. In certain embodiments, the poles, which may be used as walking sticks, may be collapsible, and may be stored in a pocket extending along a hemline of the garment or extending down a side edge of one or more of the side panels. In certain embodiments, the rear pocket, when inverted, has a length that accommodates at least one collapsed pole in each of its ends. In further embodiments, the rear pocket may fold into a V shape when the article and poles are packed into the inverted rear pocket.

In other embodiments, the article may also have a first slit and second slit, the slits disposed in or near the top corners of the rear panel and sized and positioned to allow individual's arms to pass therethrough when the article is worn as a garment.

The article may also have top strap arranged and sized to secure the article to the ground when the article is erected into the shelter and to operate as a belt when the article is worn as a garment. The top strap may be secured to the first side panel, the rear panel, and the second side panel at the top edge of the article, and it may have:

- a first top strap end that may be attached to a first top transition location positioned on the top edge and may extend unattached and freely away from the first side panel beyond the first top transition location; and
- a second top strap end that may be attached to a second top transition location positioned on the top edge, and may extend unattached and freely away from the second side panel beyond the second top transition location.

The article may also have a pair of bottom straps arranged and sized to secure the article to the ground when the article is erected into the shelter and to shorten the side panels when the article is worn as a garment. The pair of bottom straps may have:

- a first bottom strap secured to the first side panel at the bottom edge of the article, with the first bottom strap having a first bottom end permanently or releasably attachable to the first side panel front bottom corner and extending freely and unattached away from the first side panel beyond the first side panel front bottom corner; and
- a second bottom strap secured to the second side panel at the bottom edge, the second bottom strap having a second bottom end permanently or releasably attachable to the second side panel front bottom corner of the second side panel and extend ing unattached and freely away from the second side panel beyond the second side panel front bottom corner.

In addition, methods for assembling an article that may be worn as a garment into a shelter structure are disclosed, in which the garment may have a body with a bottom edge, a top edge, a rear panel, and side panels attached to side edges of the rear panel, and in which the body may have an interior surface that operates as the interior of a garment and as the interior of a shelter structure. The garment may have a collar along at least a portion of the top edge and a garment belt attached to and extending beyond the body at the top edge, and length adjustment straps arranged and sized to shorten the side panels when the article is worn as the garment.

The side panels may extend from the bottom edge to the top edge. A first side panel may have a first side panel attached edge, which is attached to a first side edge of the rear panel, and a first side panel front edge opposite to the first side panel attached edge. The first side panel front edge may extend from the top edge of the article to the bottom edge of the article, and the first side panel may have a first side panel front bottom corner disposed between the first side panel front edge and the bottom edge of the article.

A second side panel may have a second side panel attached edge, which is attached to a second side edge of the rear panel, and a second side panel front edge opposite to the second side panel attached edge. The second side panel front edge may extend from the top edge of the article to the bottom edge of the article, and the second side panel may have a second side panel front bottom corner disposed between the second side panel front edge and the bottom edge of the article.

The garment belt may have a top strap secured to the first side panel along the top edge, and the top strap may have a first top strap end and a second top strap end. The first top strap end may be is attached to a first top transition location positioned on the top edge and extends freely away therefrom. The second top strap end may be attached to a second top transition location positioned on the top edge and extends freely away therefrom.

The length adjustment straps may have a first bottom strap secured to the first side panel at the bottom edge of the article, and a second bottom strap secured to the second side panel at the bottom edge. The first bottom strap may have a first bottom end permanently or releasably attachable to the first side panel front bottom corner and extending freely away therefrom. Similarly, the second bottom strap may have a second bottom end permanently or releasably attachable to the second side panel front bottom corner of the second side panel and extending freely away therefrom.

The garment may be assembled into a shelter structure by constructing a peak on the interior surface of the body at a desired location near or along the bottom edge, forming the collar into a rear pocket for holding items within the shelter structure, securing the shelter structure to the ground with the garment belt and the length adjustment straps, and forming the collar into a carrying bag for storing the article when the article is not in use as the shelter structure or not being worn as the garment.

The desired location for the peak may be selected to ensure that the shelter structure has tensional integrity when the shelter structure is assembled and when counteracting forces applied by components of the shelter structure and by weather conditions are in balance. The peak may be formed with a flat, planar construction and of a first stretchable and cushioning material to ensure that a pole is firmly but flexibly positioned within the peak at the desired location when the article is in use as the shelter structure and to ensure that the peak lays generally flat on the interior surface of the body when the article is not in use in an assembled shelter structure.

In other embodiments, the peak may be formed with a flat peak socket, which may be attached to the interior surface at the desired location. The peak socket, which may be formed of a second stretchable and cushioning material.

In further embodiments, a point of contact within the flat peak socket may be selected to receive a tip of the pole when the pole is positioned within the flat peak socket; and an empty space may be constructed within the flat peak socket between desired location and the point of contact. In still further embodiments, the empty space may be constructed with a genetoprally triangular cushioned shape that has an opening on a first side to receive the pole, and a second side for attaching the flat peak socket to the interior surface along a line that approaches and points to the desired location. In addition, a line of reinforcing stitching may be stitched across the flat peak socket, with the reinforcing stitching applied generally perpendicular to the second side or a third side of the flat peak socket at or near the point of contact.

In addition, systems for an assembly of at least one article into a shelter for at least one individual are also disclosed, in which articles such as disclosed herein may be used to erect an individual shelter structure or may be used to erect a linked assembly of a plurality of erected shelter structures in which:

peaks of adjacent erected shelter structures overlap, with a peak of a first erected shelter structure overlapped by a peak of a second erected shelter structure;

side curtains formed with side panels of adjacent shelter structures overlap, with one of the side curtains of the first erected shelter structure overlapped by one of the side curtains of the second erected shelter structure; and one of the secured bottom straps of the first erected shelter structure may be positioned under one end of the secured top strap of the second erected shelter structure.

In certain embodiments of linked assemblies, an article may constitute a first article with a first peak and may be arranged to be assembled into a first shelter structure, and a second article with a second peak may be arranged to be assembled into a second shelter structure. When the first and second shelter structures are disposed adjacent to each other, the first article may be assembled with the second article into a linked assembly of shelter structures. When the second peak is overlayed on the first peak, the cushioned socket of the second peak may be arranged to assume a shape of the first peak thus additionally cushioning the peak socket associated with the first peak.

It may be seen that with the article disclosed herein, the article may be arranged to be worn as a garment or to provide shelter, with, when the at least one article is worn as the garment:

the top strap arranged and sized to serve as a belt, the pair of bottom straps arranged and sized to shorten the side panels, the rear pocket arranged and sized to serve as a collar, and the peak arranged to lay flat on an interior surface of the garment.

A linked assembly so erected may form a line of erected shelter structures, with the line having a beginning shelter structure and a final shelter structure. In certain embodiments, the line of erected shelter structures may form a serpentine line of shelter structures. In other embodiments, the beginning shelter structure in the assembly may be linked to the final shelter structure to form a torus-shaped linked assembly.

In certain embodiments, the article may have a first linking strap positioned on an exterior surface of the first erected shelter structure on or near the peak and a seam between the rear panel and one of the side panels. The first linking strap may be arranged to tie to a second linking strap on the second erected shelter structure to improve the linkage of the shelter structures into a stable assembly. In other embodiments, Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

BRIEF DESCRIPTION OF THE DRAWINGS

FIGS. 4A-4F are views of one of the pair of peaks 130 on the shelter structure 300, in which:

FIG. 4A is a perspective view of the exterior of a portion of an assembled shelter structure 300, illustrating one of the assembled peaks 130, FIG. 4B is a perspective view of the socket 138 on the interior of the shelter structure 300, partially assembled with a tensioning support pole disposed within, FIG. 4C is a perspective view of one of the assembled peaks 130 on the exterior of the shelter structure 300, with the gusset 136 and a D-ring loop 402 attached to the peak, FIG. 4D is a perspective view of the opposite side of the assembled peak of FIG. 4C, showing the bottom strap 124, FIG. 4E is another perspective view of the opposite side of the assembled peak of FIG. 4C, showing the pole in the socket 138 and the bottom strap 124 attached (with toggle attachment) to the bottom edge of a side curtain, FIG. 4F is a perspective view of detail of the exterior of the toggle 425 shown in FIG. 4E attaching the bottom strap 124 to the bottom edge of a side curtain, FIG. 4H-1 is a top view of an alternative embodiment of a shelter 450 having a visor 452; and FIG. 4H-2 is a top view of detail of the visor 452 in FIG. 4H-1;

FIGS. 5A-5D are views of the carrying bag 500 into which the sun protection article 100 transforms and into which the article 100 may be packed, in which:

FIG. 5A is a top view of a portion of the hood 140 and a portion of the rear pocket 150 of the sun protection article 100 laid flat, with the rear pocket configured as a collar, FIG. 5B is a top view of the rear pocket 150 laid flat and inverted using tabs 152, FIG. 5C is a top view of the rear pocket 150 configured as a collar and showing the hood inside the rear pocket 150 laid flat and inside and showing the snap straps 157 opened, FIG. 5D is a side view of the carrying bag 500 with the sun protection article 100 packed therein.

FIGS. 6A-6G are views of the sun protection article 100 converted into a garment 600, in which:

FIG. 6A is a side view of the front of the garment 600 as worn by a user, with selected portions of the garment secured with selected attachments, FIG. 6B is a side view of the rear of the garment 600 and worn as an unhooded and unbelted shell by a user, FIG. 6C is a side view of the rear of the garment 600 and worn as a hooded and belted shell by a user, FIGS. 6D-6F are views of the garment 600 displayed on a form showing attachment of the top strap 154 to the garment 600, in which:

FIG. 6D is a side view of the front of the garment 600 showing the top strap 154 attached to the collar 150, extending under the side panel 120, and looped under the bottom edge of the side panel, FIG. 6E is a side view of the side of the garment 600, showing the top strap 154 extending from the bottom edge of the side panel to and through the D-ring 402, and draped toward the ground, and FIG. 6F is a side view of the rear of the garment 600 showing the top strap 154 extending toward the ground, and FIG. 6G is a top view of the interior of the article 100 laid flat and showing attachment of the bottom strap 124, in which the bottom strap 124, which is attached to the side panel 120 from the gusset 136, extends up to the sleeve strap 158 and down toward the ground;

FIGS. 7A-7F are side views of the front of the garment 600 with selected portions of the garment secured with selected attachments, in which:

FIGS. 7A and 7B are side views of the front of the garment 600 worn as a hooded cape by a user with the bottom corners of the side panels held up by a user, FIG. 7C is a side view of a portion of the front of the garment, showing detail of a user holding up the side panels with panel loop 426 attached to the bottom corners of the side panel, FIGS. 7D and 7E are side views of the side and back, respectively, of portions of the garment as shown in FIGS. 7A and 7B, showing detail of the gusset 136 of the article 100 and showing the top strap 154 snapped together and hanging down the back of the garment 600, FIG. 7F is a side view of a portion of the front of the garment 600 of FIGS. 7A and 7B, showing more detail of a top strap 154 extending through the sleeve strap 158 disposed outside of the garment 600;

FIGS. 8A-8F are views of a cap sleeve for the armhole slits 112 in the article 100, in which:

FIG. 8A is a top view of a portion of the exterior of the article 100 laid flat and showing an armhole slit 112 formed into a cap sleeve 812, FIG. 8B is a top view of a portion of the interior of the article 100 showing two cap sleeves 812, FIG. 8C is a side view of a portion of the interior of the article 100 assembled as a shelter structure 300, with the hood (not shown) tucked into the rear pocket 150 and showing an armhole slit 112 flattened and in tension on the rear panel due to the shelter structure 300 being assembled and under tension, FIG. 8D is a side view of a portion of the exterior of the article 100 as shown in FIG. 8C and showing the armhole slit 112 from the exterior of the assembled shelter structure;

FIG. 8E is a top view of a portion of the interior of the article 100 laid flat and showing a sleeve strap 158 snapped to a corresponding snap attached to the top strap 154 of the article 100 at the shoulder through one of the two cap sleeves 812, FIG. 8F is a top view of a portion of the exterior of the article 100 as shown in FIG. 8E; and FIGS. 9A-9F are views of an alternative embodiment of the multi-functional sun protection article assembled into a garment 900, in which:

FIG. 9A is a top view of the hood 940 attached to the top edge of a sun protection article laid flat, the hood 940 having an upper hood 942 and a pair of hood extensions 944, FIG. 9B is a side view of the side of the garment 900 worn as a hooded and unbelted shell by a user, FIG. 9C is a side view of the front of the garment 900 worn as an unhooded and unbelted shell by a user, FIGS. 9D and 9E are side views of the front and side, respectively of the garment 900 worn as a hooded and unbelted shell by a user, and FIG. 9F is a side view of the front of the garment 900 worn as an unhooded shell by a user, with one side panel extending over the other side panel, with the top strap 954 used as a belt on the garment (by the first and second top straps ends of the hood strap 954 extending behind the wearer, in opposite directions crossing the back of the garment at the waist of the wearer, and extending to the front of the wearer, after which they may be secured to each other), and with the side panels extending unfolded to the ground, with the bottom straps (not shown) tied in a knot on the back, and with the user wearing the shelter poles as walking sticks.

DETAILED DESCRIPTION

Reference will now be made in detail to the present exemplary embodiments of a sun protection article, examples of which are illustrated in the accompanying drawings. Wherever possible, the same reference numbers will be used throughout the drawings to refer to the same or like parts.

Sun Protection Article 100

Figure 1A:
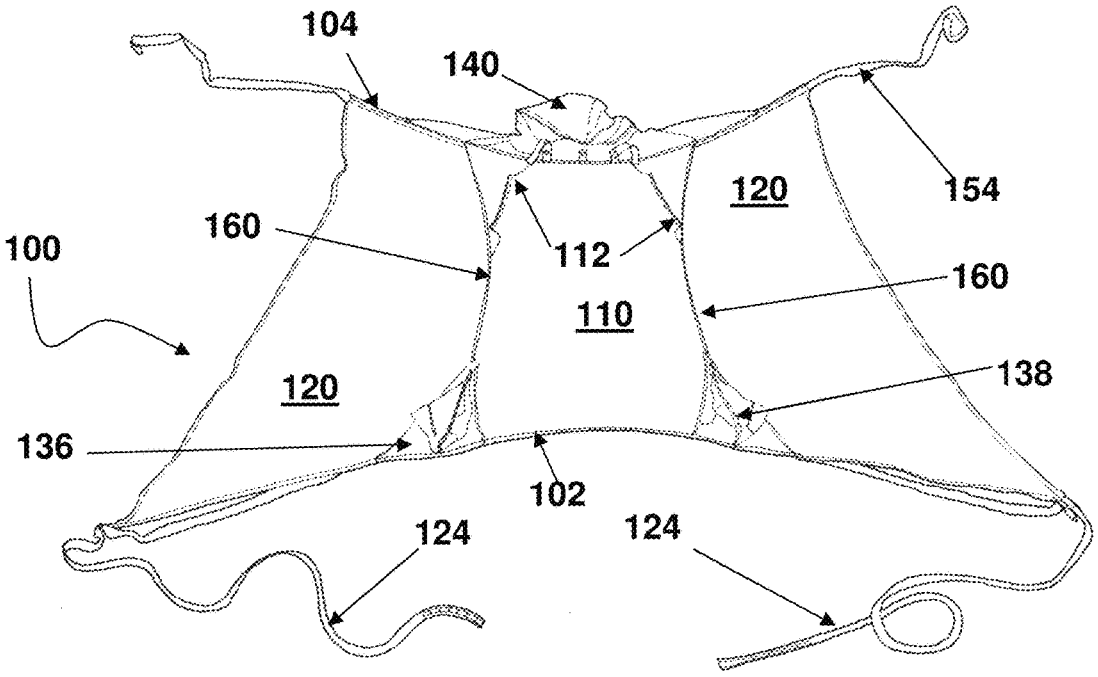
FIG. 1A is a perspective view of an illustrative but not necessarily preferred embodiment of an interior of a multi-functional article 100, also known as a sun protection article 100, unassembled and unworn and laid on the ground.
Figure 1B:
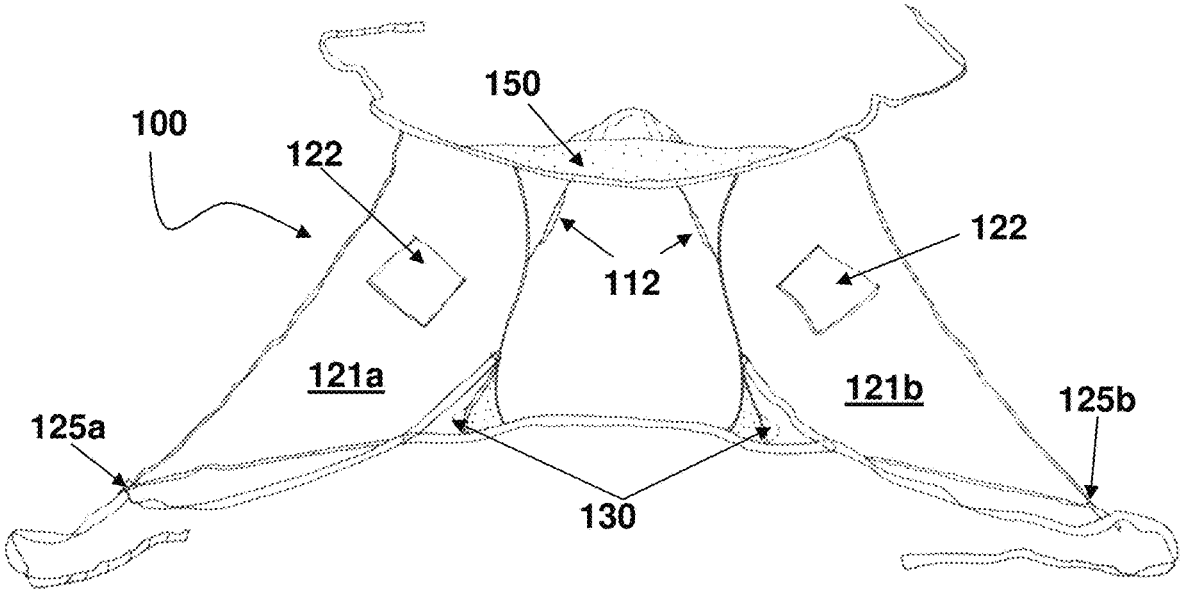
FIG. 1B is a perspective view of an exterior of the sun protection article 100 shown in FIG. 1A, unassembled and unworn and laid on the ground.
Figure 1C:
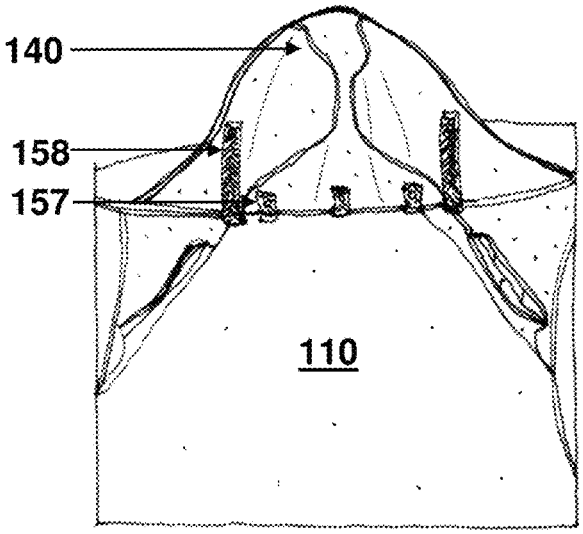
FIG. 1C is a top view of the hood 140 shown in FIG. 1A and attached to the top edge of the sun protection article.

An illustrative but not necessarily preferred embodiment of the current invention is shown in FIGS. 1A-1C as a sun protection article 100, also known as a "protection article" or "article," that may be assembled, with poles and pegs, into a shelter structure 300 (also known as a "shelter" or a "structure") for protection from sun exposure, converted into a carrying bag 500 for itself, and may also serve as a garment 600.

In the embodiment shown in FIGS. 1A-1C, the article 100 may have a body that may be defined by a bottom edge 102, a top edge 104, a rear panel 110, which may extend from the bottom edge 102 to the top edge 104, and a pair of side panels 120 extending from the bottom edge to the top edge. The interior surface of the body may operate as an interior of the garment and as an interior of the shelter structure.

The rear panel 110, which may be formed from a breathable stretch knit material, such as of a polyester/lycra composition. The rear panel 110 may also be formed of a patterned stretch material, including without limitation, a knitted fabric, a jacquard, or a matelassé. The rear panel 110 may also have armhole slits 112 on the top corners of the panel 110 for use, as later disclosed, as armholes when the article 100 is worn as a garment.

The rear panel may be stabilized by the pair of side panels 120, which may be attached to the side edges of the rear panel, in some embodiment by being stitched to the side edges, defining seams 160 extending on one side of the rear panel from a first point of attachment of the rear panel to the first side panel to near the bottom edge of the article and extending on the other side of the rear panel from a second point of attachment of the rear panel to the first side panel to near the bottom edge of the article. In certain embodiments, the side panel may be integral with the rear panel. The pair of side panels may have a first side panel and a second side panel.

The first side panel 121*a* may have a first side panel attached edge that may be attached to a first side edge of the rear panel, in some embodiments from a first side panel attached top corner of the first side panel to a first side panel attached bottom corner of the first side panel, the first side panel attached top and bottom corners being attachable to corners on the first side edge of the rear panel. The first side panel 121*a* also may have a first side panel front edge opposite to the first side panel attached edge and that extends from a first side panel front top corner of the first side panel to a first side panel front bottom corner 125*a* of the first side panel, with the first side panel front bottom corner 125*a* disposed between the first side panel front edge and the bottom edge of the article.

The second side panel 121*b* may have a second side panel attached edge that may be attached to a second side edge of the rear panel, in some embodiments from a second side panel attached top corner of the second side panel to a second side panel attached bottom corner of the second side panel, the second side panel attached top and bottom corners being attached to corners on the second side edge of the rear panel. The second side panel 121*b* also may have a second side panel front edge opposite to the second side panel attached edge and that extends from a second side panel front top corner of the second side panel to a second side panel front bottom corner 125*b* of the second side panel, with the second side panel front bottom corner 125*b* disposed between the second side panel front edge and the bottom edge of the article.

The side panels may be formed of a woven material such as polyester, for example including without limitation breathable uncalendared polyester taffeta, polyester (ripstop taffeta), nylon ripstop, nylon ripstop taffeta, cotton, and rayon; and may be selected to withstand exposure to sunlight. The woven materials may also be densely woven and of deep colors, to achieve a UPF 50 rating for skin protection.

The side panels 120 may also have a side pocket 122, which may be attached to the exterior of the side panels. As shown in FIG. 1C, the article 100 also may have a hood 140 attached to the top edge 104. The hood 140 may be sewn onto the article or releasably attachable, for example, with any conventional attachments, including without limitation snaps, zippers, or hook and loop fasteners such as the Velcro™ fasteners which are available from Velcro USA Inc. of Manchester, NH. In certain embodiments, the hood may be integral with the rear panel. The article 100 also may have snap straps 157 and sleeve straps 158, described in greater detail below. Further, the article 100 may also be fitted with technology (installed therein or attached thereon) to enable collection of power for charging devices like cell phones and computers that may be used out of doors and for monitoring time exposure to UV rays.

The article 100 may also have atop strap 154, arranged and sized to secure the article to the ground when the article is erected into the shelter and to operate as a belt when the article is worn as a garment. A top strap may have an attached portion secured to at least a portion of the top edge of the article 100, for example, it may be secured to a side panel at a selected location on the top edge of the article (with the selected location being a first top transition location on the top edge of the first side panel, and the second top transition location on the top edge of the first side panel), and extend unattached beyond the top edge selected location a length selected to allow their dual functions to be performed.

In certain embodiments, the top strap 154 may be a single strap that is attached to and extends across most of the length of the top edge, in one embodiment from one end to the other of the rear pocket 150, shown in FIG. 1B and described below, then extending unattached beyond the ends of the rear pocket 150. In another embodiment, the single strap may be attached to and extend across the length of the top edge from a first top corner of the first side panel (which may constitute a first point of attachment of the rear panel to the first side panel) to the second top corner of the second side panel (which may constitute a second point of attachment of the rear panel to the second side panel), and then extend unattached beyond the ends of the rear pocket 150. When the top strap is not a single strap, the top straps may be attached to and extend across the top edge to join at a location on the top edge that may be selected by the designer.

The article 100 may also have a pair of bottom straps 124, with a first bottom strap and a second bottom strap arranged and sized to secure the article to the ground when the article is erected into the shelter and to shorten the side panels when the article is worn as a garment. A bottom strap may have an attached portion secured to at least a portion of the bottom edge of the article 100 for example, it may be secured to a side panel at a selected location on the bottom edge 102 of the article, and an unattached portion which extends unattached beyond the bottom edge a length selected to allow their dual functions to be performed.

It may be seen in FIG. 1B that the first bottom strap may be secured to the first side panel on the bottom edge at the first side panel front bottom corner and at a selected first side panel bottom location positioned near a base of the peak, with the first bottom strap extending between the first side panel front bottom corner and the selected first side panel bottom location along but unattached to the bottom edge. FIG. 1B also shows that the second bottom strap may be secured to the second side panel on the bottom edge at the second side panel front bottom corner and at a selected second side panel bottom location positioned near the base of the peak, with the first bottom strap extending between the second side panel front bottom corner and the selected second side panel bottom location along but unattached to the bottom edge.

Figure 4A:
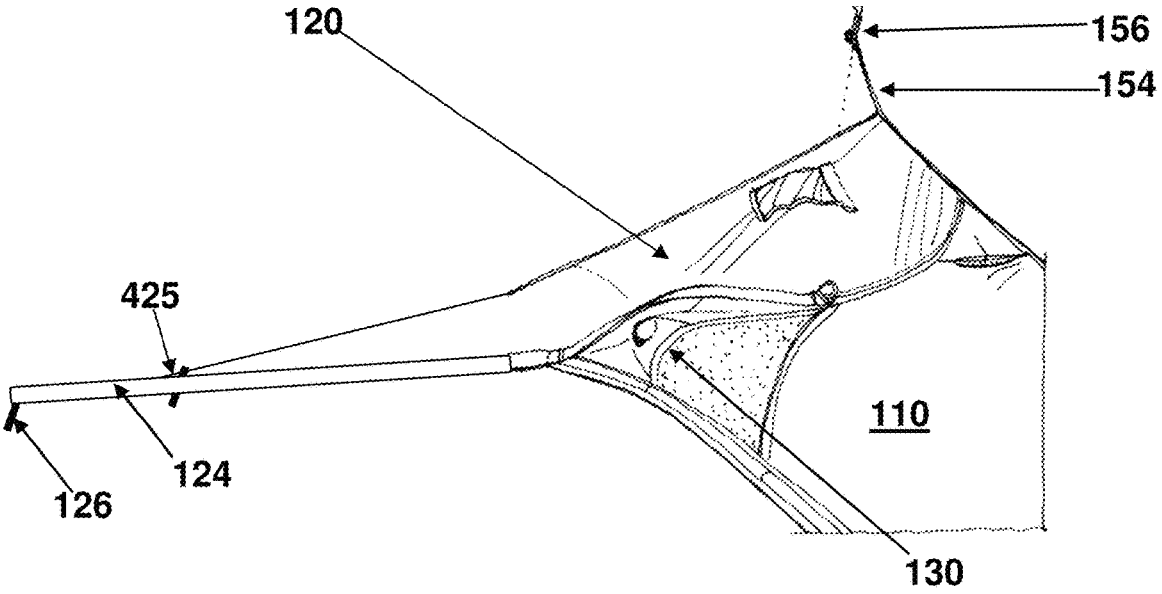
Figure 4B:
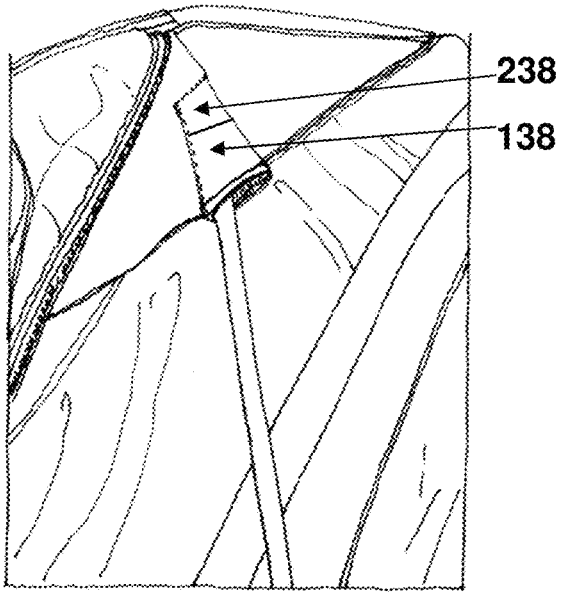
Figure 4C:
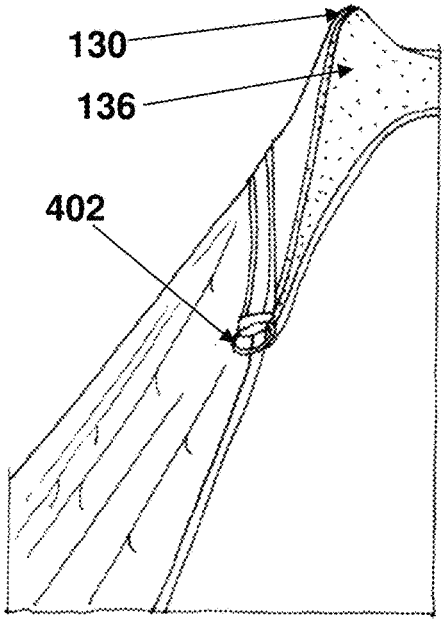

In certain embodiments, the pair of bottom straps 124 may be a single strap that is attached to and extends across most of the length of the bottom edge, in one embodiment from one end to the other of the bottom edge, then extending unattached beyond the ends of the bottom edge the selected length. When the straps are not a single strap, they may be attached to and extend across the side panels at their bottom edges from the gussets 136, described below, to the first and second side panel front bottom corners of the side panels, after which they may extend unattached the selected length. In certain embodiments, whether the bottom straps are a single strap or two straps, whether they extend across the length of the bottom edge of the article or do not extend across the rear panel, the bottom straps may be selectively attached to the bottom edge, for example as shown in FIG. 1B as attached at the two bottom corners of the side panels but remaining unattached therebetween. In other embodiments, such as is shown in FIG. 1B, 4C, a bottom strap 154 may originate at the junction of the side seam 160 and the peak gusset 136, where the D-ring 402, described below, is attached. It may then travel under a peak 130 to the base of the peak where it meets and is attached to the bottom edge 102. It may then extend freely along the side panel 121*a* until it meets and is attached to the bottom corner of the side panel 121*a*, after which it extends freely a selected distance from the side panel.

In the embodiment shown in FIGS. 1A and 1B, a pair of peaks 130 are disposed on the article 100 near or along its bottom edge 102 and near or along the seams between the rear panel 110 and the side panels 120, with a first peak between the rear panel 110 and a first side panel 121*a*, and a second peak between the rear panel 110 and a second side panel 121*b*. In the embodiment shown in FIGS. 1A and 1B, the article 100 has two peaks 130 disposed near or along the bottom edge 102, but it is to be understood that in other embodiments, more than one peak may be disposed along the seam between the rear panel 110 and a side panel. For example, another embodiment may have two peaks along or near the top edge and two peaks along the bottom edge to form a square top. In certain embodiments, the peaks may be disposed elsewhere on the article not along or near the seam 160; in other embodiments, the article 100 may have more than one peak or only one peak.

Figure 2A:
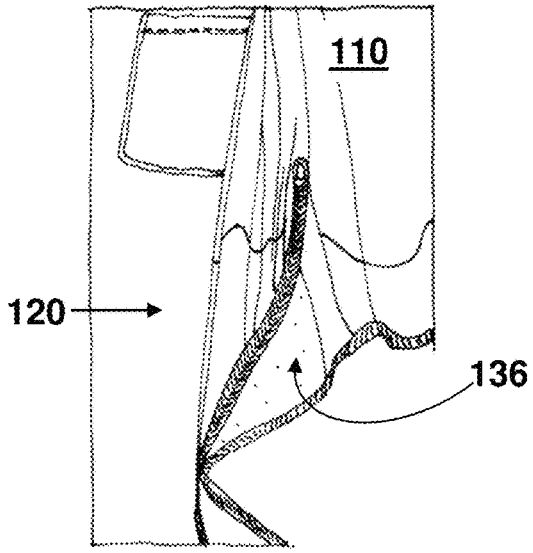
FIG. 2A is a side view of a gusset 136 positioned near the bottom edge of the sun protection article 100.
Figure 2B:
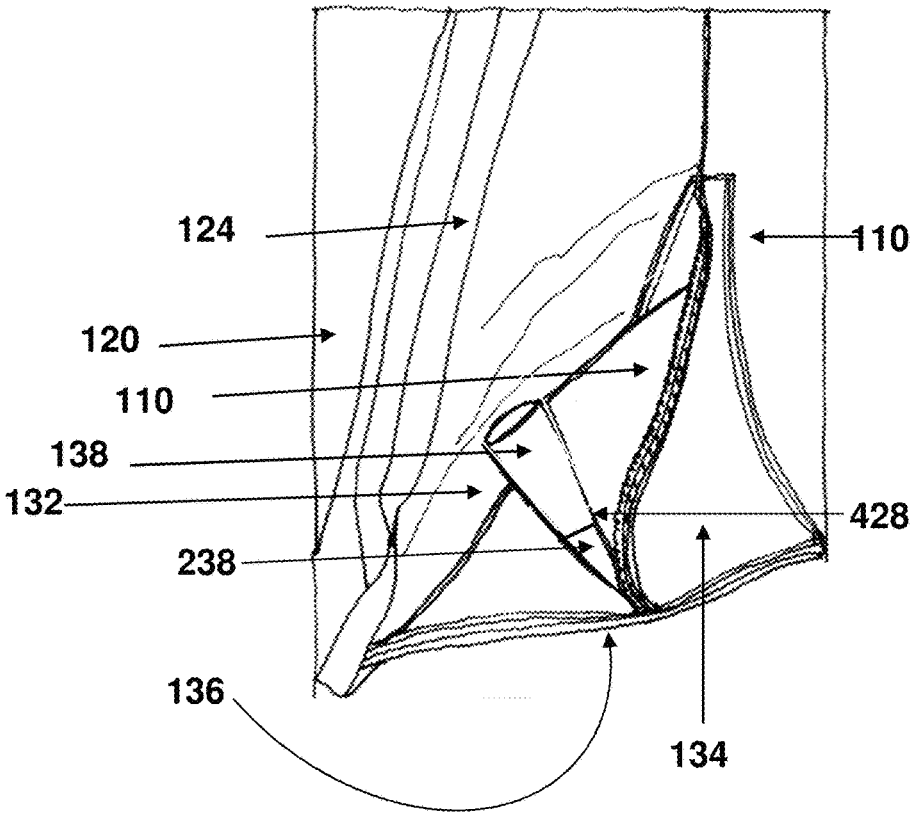
FIG. 2B is a side view of a socket 138 associated with the gusset 136 and positioned near the bottom edge of the sun protection article 100.

The interior of an illustrative but not necessarily preferred peak is shown in FIGS. 1A, 2B, and the exterior of the peak is shown in FIG. 1B and in more detail in FIGS. 2A, as having a gusset 136 formed of two gussets (triangular extensions 132, 134), which are joined by a seam with a socket 138 attached at the seam line. The triangular extensions 132, 134 may be formed of material (including, without limitation, polyester spacer mesh) sewn to a side edge of the rear panel 110 and the side edge of a side panel 120 to form a peak gusset 136. As may be seen in the peaks shown in FIGS. 4A, 4C, 4D, and 4E, the material from which a peak may be formed may be stretchy and cushiony.

In addition, along with the gusset 136, the peak may be formed from and have a socket 138 made with spacer mesh and sized to receive a supporting member, such as a pole, may be sewn to the interior of the article 100 at the seam between the triangular extensions 132, 134. The socket 138 is sized to receive a pole to be used to support and tension the shelter structure 300, as disclosed below. The socket 138 may be cushioned at a point of contact within the cushioning socket arranged to receive the tip of the pole when the pole is received within the cushioning socket. The additional cushioning may help to keep the pole from tearing through the top of the gusset when the pole is under tension in the assembled shelter. The cushioning may be provided by forming the socket with multiple layers of cushioning material, in certain embodiments by doubling the material at least once over itself. Further, an empty space 238 may be provided in the socket after the point of contact for the tip of the pole in the interior of the socket to provide additional cushioning for the tip of the pole within the peak. A line of reinforcing stitching 428 may be disposed across the cushioning socket 138 to form the triangular empty space between the peak gusset and the point of contact for the tip of the pole. The line of stitching 428 may be stitched across the socket to form the triangular empty space in the socket near the lower edge 102, to further reduce the likelihood that the pole will tear through the gusset.

The seams 160 between the rear panel and the side panels form curves extending from the top edge 104 to the beginning of the gusset 136. In certain illustrative but not necessarily preferred embodiments, the curves may be arcs. In certain further embodiments, the curves may be parabolic, with a vertex on the seam 160 and a focus that may be positioned on the surface of a side panel. In still further embodiments, the pair of seams 160 may be hyperbolic. In other embodiments, the curves may be S-shaped.

In addition, the top edge 104 may also form a curve. As with the seams 160, in certain illustrative but not necessarily preferred embodiments, the top edge 104 may be an arc. In certain further embodiments, the top edge may be parabolic, with a vertex on the top edge 104, a focus positioned on the surface of the hood, and an axis of symmetry running through a centerline of the hood. In other embodiments, such as disclosed in more detail below with reference to FIG. 4G, the top edge 104 may be S-shaped, with the top edge forming an s-shape formed when multiple shelters are joined into a linked assembly of shelter structures, such as are described below, with adjacent shelters sharing side curtains and in certain embodiments, having their seams 160 adjacent to each other.

Figure 4D:
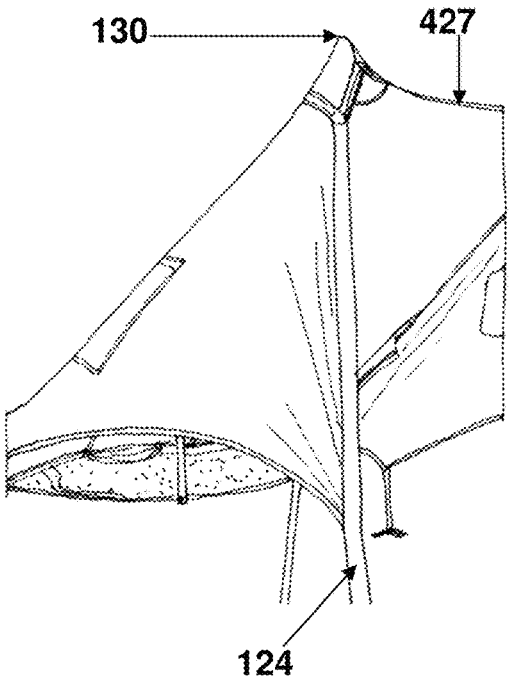

In addition, the bottom edge 102 may also form a curve. Due to the give of the stretchable fabric from which the rear panel is formed, when the bottom straps 124, also known as bottom tiedown straps or bottom tiedowns, especially when the article is assembled into a shelter, are secured to the ground and the article is pulled away from the secured strap ends, the bottom edge 102 may form an arc. In certain further embodiments, the bottom edge may be parabolic. Further, as shown in FIG. 4D, a stabilizing strap 427 may be attached along the bottom edge 102 between the bottom tiedown straps 124, from one peak gusset to the other peak gusset. The stabilizing strap 427 may provide stability to the edge of the rear panel by counteracting the pulling forces against the poles/peaks in nearly opposite directions that the bottom tiedown straps 124 exert. Thus, the stabilizing strap may counteract pulling forces exerted against the peak by the bottom straps and the pole when the article is erected into the shelter structure.

The stretchiness from which the rear panel is made may cause the bottom edge to be pulled or stretched out of shape due to the pulling forces inflicted on it by the bottom tiedown straps 124. Stretched-out material of the edge could cause the lower edge to flap, degrading the lift that the airflow provides the structure; it could degrade the balance in pushing/pulling forces that keep the structure stable. By maintaining the balance in pushing/pulling forces exerted on the shelter structure, the stabilizing straps may prevent or minimize the amount of stretching out that the rear panel undergoes.

Further, in certain illustrative but not necessarily preferred embodiments, the first and second side panel attached edges of the side panel (which run between the top strap 154 and bottom straps 124, also known as the tiedown straps 124, 154 or tiedowns, especially when the article is assembled into a shelter) may form curves extending between the tiedown straps. In further embodiments, a side edge curve may be an arc, and in even further embodiments, the curve may be parabolic, with a vertex on the seam 160 and a focus 106 positioned in the space below the side edge. In other embodiments, the side edge curves on the side panels may be complementary in size and angles, and in further embodiments, the pair of side edges may be hyperbolic. In other embodiments, as noted above, the curves may be S-shaped.

In certain illustrative but not necessarily preferred embodiments, the curves may be selected "organically" to the function—when the shelter is pitched, the side curtains stretch into a different form, and the pattern of their edges may be based on how the curtains respond to wind. Once the shelter is pitched, the designer may cut the side edges to his or her preference. One advantage of basing the patterning and cutting of components of article 100 on parabolic form is its likelihood of eliminating extraneous fabric in production, enabling sustainable production.

The article 100 also has a top tiedown strap 154, which may also be known as a hood strap, a top strap, or a top tiedown, which is attached (in certain embodiments, sewn) to the top edge 104 of the article 100. In certain embodiments, the top strap may be sewn to the top edge 104 on the exterior of the article 100.

The article 100 also may have bottom straps 124, which may be attached (in certain embodiments, sewn) to the bottom edge 102 of the article 100. In certain embodiments, the bottom tiedown straps, which may also be known as bottom tiedown straps, especially when the article is assembled into a shelter or which may also be known as length adjustment straps, especially when the article is worn as a garment, may be sewn to the exterior of the article 100. In other embodiments, if the bottom edge of the article 100 has a raw (unfinished) edge of material or materials, the bottom straps may be folded and fit over the bottom edge 102 and sewn thereto in order to finish the raw edge. In certain embodiments, the bottom straps may be arranged to hold one or more drawstrings for containing the width of the bottom edge when the article is worn as a garment.

Figure 4E:
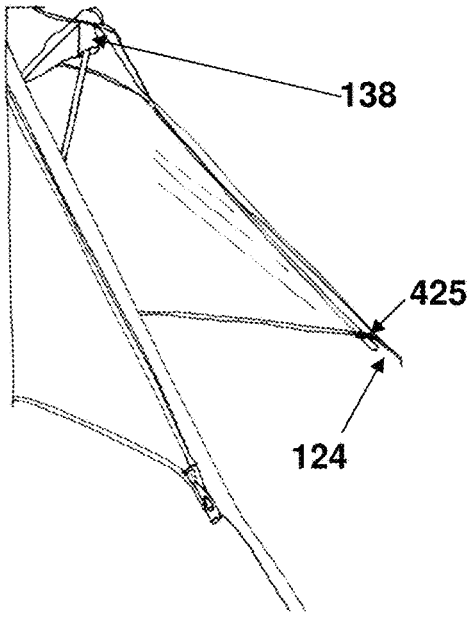

In certain embodiments, the bottom straps may extend across the entire length of the bottom edge 102; in other embodiments, the bottom straps 124 may be sewn to the bottom edge of the side panel from the bottom corner of the side panel to the peak gusset 136, and then along the seam between the side panel and the gusset triangular extension 132. In other embodiments, such as shown in FIGS. 1B and 4E, the bottom straps 124 are attached along the seam between a side panel and the gusset triangular extension 132 and are then loose for the length of the bottom edge of the side panel but are arranged to attach to the free bottom corner of the side panel using a conventional attachment such as a toggle 425. In certain embodiments, a loop may be attached to the top strap 154 and a toggle attached to the bottom corner of the side panel. In other embodiments, such as the embodiment shown in FIG. 4D, the toggle 425 may be attached to the top strap 154 and a loop 426 attached to the bottom corner of the side panel.

Without limitation, the top and bottom straps may be formed of 1" wide polyester webbing or 1" wide polyester twill tape, or of nylon or cotton, and are arranged, when pulled tight (around plastic pegs or tied to an anchor point), to provide tension to hold the shelter in place.

Shelter Structure 300

The sun protection article 100 may be assembled into a shelter structure 300 that may be temporarily constructed to provide controlled exposure to sun by a user or users. In the disclosure herein, the shelter structure also may be known as a shelter, canopy, sunscreen, or sunshade. As shown below, the shelter may be erected individually or in linked groups in a myriad of locations such as in a park, a back yard/garden, or at the beach, The rear panel and the side panels of the article 100 may operate as the body of the structure, with the rear panel serving as the top of the structure, the side panels serving as side curtains for the structure, and the article's top and bottom straps serving to secure the structure to the ground and, along with retaining poles, to exert tensioning forces on the structure to provide and maintain the structural integrity of the shelter.

The article may be delivered to the site in an assembled bag 500 or as a three-dimensional textile garment 600, disclosed in more detail below. However the article is delivered to the selected site, the article may be erected to become a shelter from weather elements such as wind, rain, snow, and sun. Erecting the shelter involves determining an appropriate initial positioning of the shelter relative to the sun so that the shade print on the ground is satisfactory to the shelter user. Once an orientation is established, the article may be laid on the ground exterior surface facing up.

The article may then be secured to the ground using securing elements and poles to provide tensioning support. The securing elements may be any conventional device to secure the structure to the ground. For example, when the shelter is constructed on sand or grass, pegs or rods may be driven through the ground, and bottom tiedowns 124 and top tiedowns 154 may be attached to the pegs or rods in any conventional way (for example, the tiedowns 124, 154, which may have adjustable loops, may have grommets, not shown through which the pegs or rods many be passed). When installed over solid ground, for example on a deck or patio, the shelter may be secured by using weights or cleats, and tiedowns 124, 154 may be disposed under the weights or attached to the cleats, also in any conventional way to anchor the tiedown straps in place.

One set of tiedown straps (in one embodiment, the bottom tiedown straps 124) may be tightened into forming an parabolic arc, and tiedown strap (in one embodiment the top tiedown strap 154) is extended and pulled forward loosely. Slack in the lines allows a user to lift up the structure and insert poles, which may be sized to have a length that is slightly longer than the distance from the ground to the peak 130, into the peak sockets 138 under the peaks, as shown in FIGS. 4A and 4B. With the poles so positioned, the tiedown straps and their associated securing elements may be adjusted to pull the whole structure into proper tension. The side curtains may be secured to the bottom tiedowns 124 using a conventional securing device such as wood toggles 425 attached to the bottom corners of the side curtains.

The shelter 300 is thus supported in tension, as shown in FIGS. 4B and 4C by slipping poles into the peak sockets 138 to form the peaks 130 and raising the article into the air. It should be noted that, due to the support of the tent by poles inserted into the sockets near or along the bottom edge of the article 100, the erected shelter will be lower to the ground at its top edge 104 and higher off the ground on the bottom edge 102 of the article. Accordingly, a user will typically enter and exit the shelter structure from the bottom of the article. For full shade inside the enclosure, a separate blanket or other suitable covering may be added to block all or most sunlight from entering the enclosed space. Entrances to the sheltered area may be created by altering the angle of engagement of the shelters at the peaks.

In certain embodiments, the poles may be collapsible, or they may be formed of any light-weight material such as aluminum. or bamboo material; they may be collapsible, adjustable, or of a single thin straight piece or bar of material. They may also be lightweight. Alternatively, they may be designed to also serve as a walking sticks when the article is transformed into a garment.

When the shelter is tensioned using the poles, the tiedowns, and securing elements such as ground pegs, the non-rigid fabric of the side curtains 121*a*, 121*b* and the center back panel 110 transform the shelter into a rigid lean-to structure, with the curved seams able to deflect wind loads of up to speeds of approximately 20 mph.

The seams 160 of the article 100 may form the shelter's backbone and the curves of the bottom edge 102 and top edge 104 are pulled tight to define the volume of the shelter.

As such, side curtains 120 operate as wings to raise the shelter structure away from the ground and promote cooling air flow through the interior space of the erected shelter structure 300.

When the tiedown straps 124, 154 are loosely secured to the ground and poles are disposed between the sockets 138 and the ground, the article 100 is tensioned and is hoisted into the air. The stretchiness of the rear panel 110 operates to enable the article to stretch under tension to create a stable shelter. The poles, curved edges 102, 104, seams 160, stretchiness of the rear panel, and straps 124, 154 cause the article 100 to be formed into a tensegrity structure (also known as tensional integrity) that expands in the wind and contributes to the agility of the overall assembled structure.

The structure may be assembled thus to provide individual shelter. Alternatively, one or more wearable or non-wearable articles may be linked together to form a group or an enclosure of larger or shared shady areas similar to umbrellas. In a group assembly such as the shelter 400 shown in FIG. 4G, peaks of adjacent articles 101-1, 101-2, 101-3 may share poles, such that peaks 430-1, 430-2, 430-3 of a shelter 400 have disposed within them, first second, and third poles, respectively, with:

- peak 430-1 formed by lapping a peak 131-2 of article 101-2 over the peak (not shown) of an article 101-1 that is positioned adjacent to the peak of article 101-2, with the peak socket (not shown) of the peak 131-2 laying flat against the peak (not shown) of the article 101-1, and disposing from the interior of the shelter 400 a first pole (not shown) in a socket (not shown) of the article 101-1;
- peak 430-2 formed by lapping a peak 131-3 of article 101-3 over the other peak (not shown) of article 101-2 (which is positioned adjacent to the peak of article 101-3), with the peak socket (not shown) of the peak 131-3 laying flat against the peak (not shown) of the article 101-2, and disposing from the interior of the shelter 400 a second pole (not shown) in a socket (also not shown) of the article 101-2; and
- peak 430-3 formed by lapping the other peak 131-3 of article 101-3 over the other peak (not shown) of article 101-1 (which are positioned adjacent to each other), with the peak socket (not shown) of the other peak 131-3 laying flat against the other peak (not shown) of the article 101-1, and disposing from the interior of the shelter 400 a third pole (not shown) in the other socket of the article 101-1.

Figure 4F:
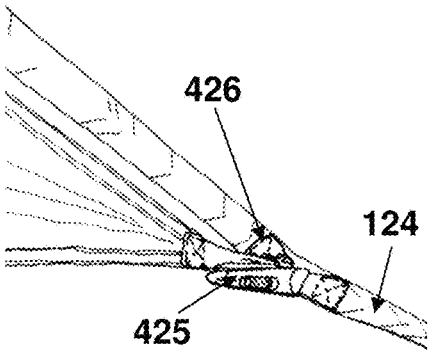
Figure 4G:
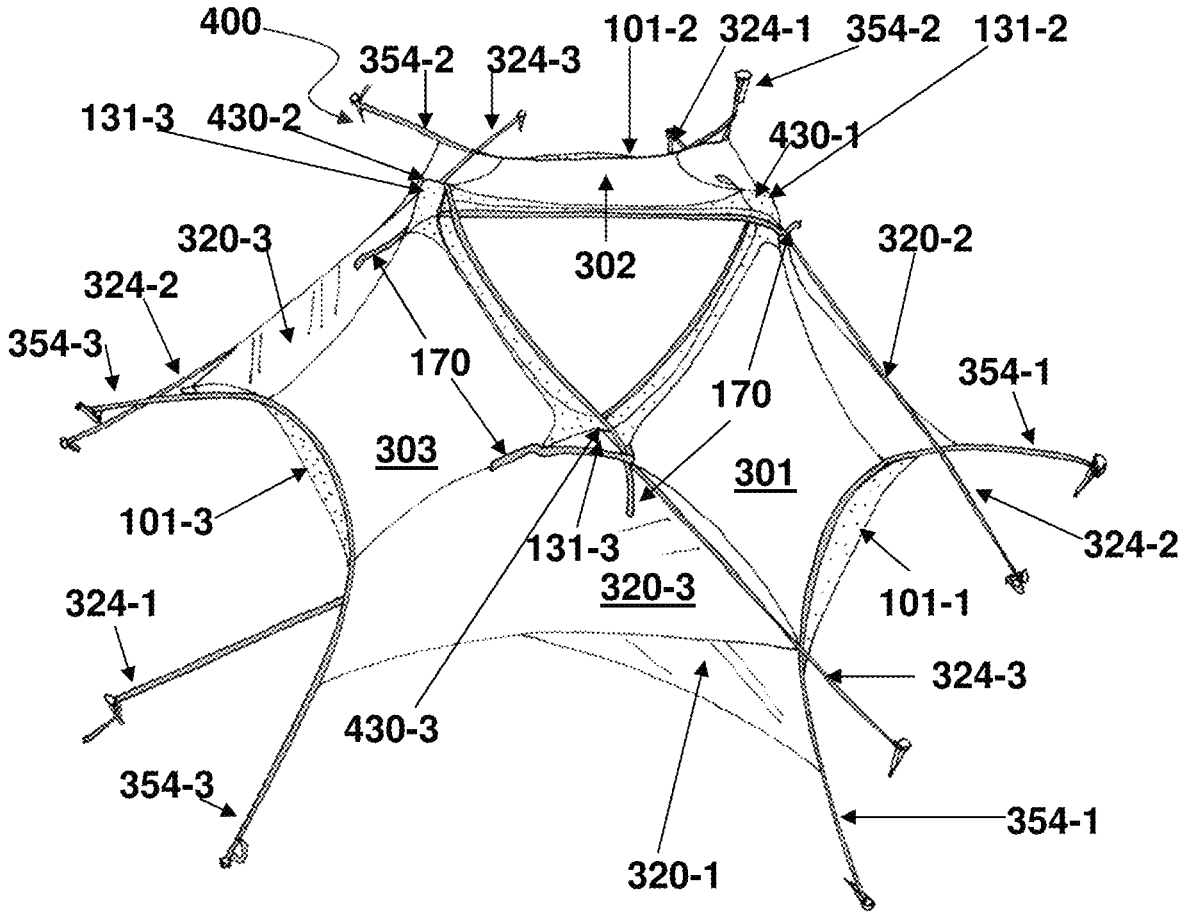
FIG. 4G is a top view of a linked shelter structure 400 erected using three shelter structures 301, 302, 303.

Thus, in FIG. 4G, three poles may be used to support a linked assembly of three multi-functional articles, with:

- the first pole disposed in a peak socket for a first peak of a first article (the article 101-1), which itself is disposed under a first peak of a second article (the article 101-2);
- the second pole disposed in a peak socket for the second peak of the second article (the article 101-2), which itself is disposed under a first peak of a third article (the article 101-3); and
- the third pole disposed in a peak socket for the second peak of the first article (the article 101-1), which itself is disposed under the second peak of the third article (the article 101-3).

Adjacent side curtains from both tents may be overlapped and the tiedowns secured to create a large, secure shady area underneath the shelter. Further, articles 101-1, 101-2, 101-3 may have linking straps 170 positioned on the articles on or near the peak gusset and the seams between the rear panel and the side panels for tying one shelter to another.

In the embodiment shown in FIG. 4G, a plurality of multi-functional articles 101-1, 101-2, and 101-3 may be assembled together to form the linked shelter 400. In one illustrious but not necessarily preferred embodiment, the shelter 400 may be erected as follows:

- the tiedown straps 324-1, 354-1 of the article 101-1 are loosely secured to the ground, for example using the methodology disclosed above for the construction of the shelter 300;
- the tiedown straps 324-2, 354-2 of the article 101-2 are loosely secured to the ground,
  - with both the side curtain 320-2 and top tiedown strap 354-2 that are adjacent to the article 101-1 draped over both the side curtain 320-1 and the top tiedown strap 354-1 that are adjacent to the article 101-2, and
  - with both the side curtain 320-3 and top tiedown strap 354-3 that are adjacent to the article 101-2 draped over both the side curtain 320-2 and top tiedown strap 354-2 that are adjacent to the article 101-3; and
- the tiedown straps 324-3, 354-3 of the article 101-3 are loosely secured to the ground,
  - with both the side curtain 320-3 and top tiedown strap 354-3 that are adjacent to the article 101-2 draped over both the side curtain 320-2 and top tiedown strap 354-2 that are adjacent to the article 101-3, and
  - with both the side curtain 320-3 and the top tiedown strap 354-3 that are adjacent to the article 101-1 draped over both the side curtain 320-1 and the top tiedown strap 352-1 that are adjacent to the article 101-3;
- the first and third poles are inserted into the peak sockets of the first article 101-1 and disposed between the ground and the socket to hoist up the article 101-1;
- the article 101-1 tiedown straps 324-1, 354-1 are tightened to assemble the first shelter 301;
- the article 101-2 peak that is adjacent to the shelter 301 is draped over the shelter 301 peak that is adjacent to the article 101-2 and is adjusted to be disposed above the shelter 301 peak to form a peak 430-1;
- the second pole is inserted into the peak socket for the other peak of the second article 101-2, and disposed between the ground and the socket to hoist up the article 101-2;
- the article 101-2 tiedown straps 324-2, 354-2 are tightened to assemble a second shelter 302;
- the article 101-3 peak that is adjacent to the shelter 302 is draped over the other peak of the shelter 302 and is adjusted to be disposed above the shelter 302 peak to form a peak 430-2;
- the other article 101-3 peak, which is adjacent to the shelter 301, is draped over the peak of the shelter 301 that is adjacent to the article 101-3 and is adjusted to be disposed above the shelter 301 peak to form a peak 430-3; and
- the article 101-3 tiedown straps 324-3, 354-3 are tightened to assemble a third shelter 303 that is linked, for example, with linking straps 170, to the shelters 301, 302 to form the linked shelter 400.

It may be seen that an article user may assemble the linked shelter 400 with any convenient method. While alternative methods for assembling the linked shelter may have similar actions (securing and tightening tiedown straps to the ground, positioning the poles in sockets, overlapping selected tiedown straps and side curtains), the order for performing the assembling steps may be left to the user. For example, a user may:

assemble the shelter 301 by securing the ends of the top tiedown strap 354-1 to the ground, inserting the first and third poles in the peaks of the article 101-1, securing the bottom tiedown straps 324-1 to the ground, and tightening the tiedown straps 324-1, 354-1;

assemble the shelter 302 in a manner similar to the process for assembling the shelter 301, with the addition of draping both the side curtain 320-2 and top tiedown strap 354-2 that are adjacent to the shelter 301 over both the side curtain 320-1 and the top tiedown strap 354-1 that are adjacent to the shelter 302; and assemble the shelter 303 in a manner similar to the process for assembling the shelter 301 and 302, with the addition of draping both the side curtain 320-3 and top tiedown strap 354-3 that are adjacent to the shelter 302 over both the side curtain 320-2 and top tiedown strap 354-2 that are adjacent to the shelter 303, and draping both the side curtain 320-3 and the top tiedown strap 354-3 that are adjacent to the shelter 301 draped over both the side curtain 320-1 and the top tiedown strap 352-1 that are adjacent to the shelter 303.

For additional stability, the D-ring loop 402 shown in FIG. 4C as attached to the end of a tiedown strap near a peak of a multifunctional article (the D-ring so positioned to be used for securing the bottom tiedown when the article is worn as garment 600) may be used for tying one shelter to another when multiple shelters are linked by overlapping peaks and shared poles.

The shelter may be provided in non-wearable embodiments. In addition, wearable and non-wearable shelters may also be designed in different sizes to accommodate individuals of different sizes, or provide an individual with greater leisure space. Such non-wearable articles or differently sized articles may still be assembled as part of a group enclosure. In another embodiment of a linked assembly, multiple articles may be linked together in a line of shelters with side curtains of adjacent erected shelter structure overlapping each other. In certain embodiments, side seams of adjacent erected shelter structures are superimposed, resulting in the linked assemblies being formed into a ring of erected shelter structures, forming a torus of shade for more than one individual. In embodiment, when the shelters are positioned such that their side seams are not adjacent to each other, the linked assembly, instead of forming a torus of shade, a line of erected shelter structures, in further embodiments, forming a serpentine line of erected shelter structures.

Bag 500

As shown in FIG. 5A-5E, the article 100 may be delivered to a site in an assembled bag 500 formed from the rear pocket 150 of the article 150. It may be carried as a fashionable accessory like a purse, worn around the waist as a fanny pack, or slung over a user's shoulders as a cross body bag.

Figure 5A:
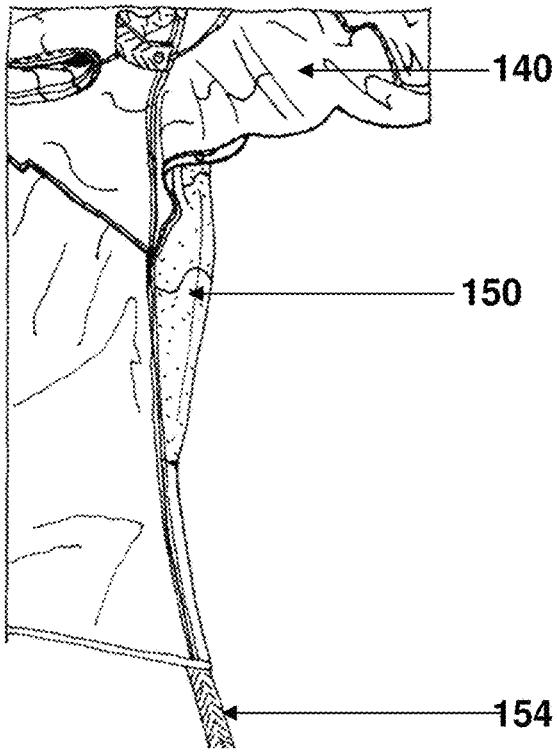
Figure 5B:
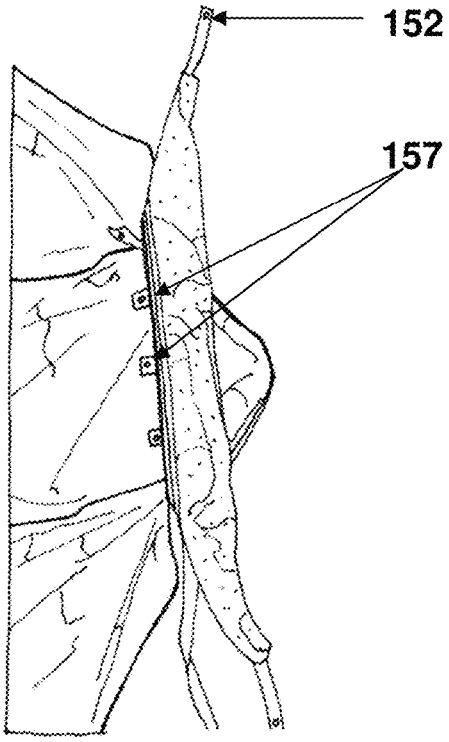
Figure 5C:
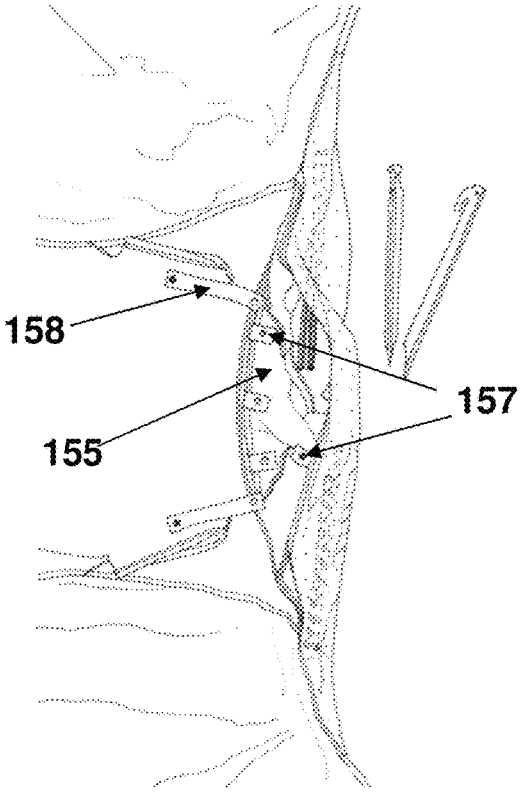
Figure 5D:
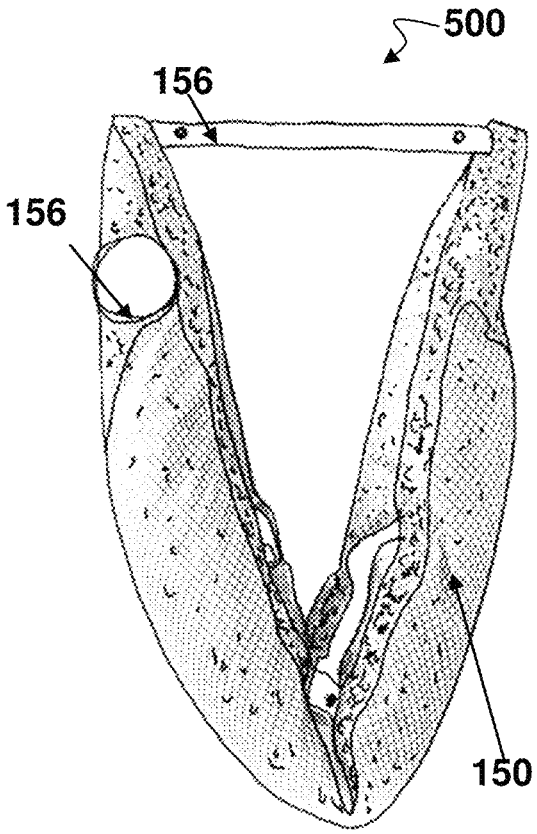

The article itself may pack into itself, resulting in a bag that contains the fabric assembly, pegs, and two poles. In this application, going forward, the term "peg" is non-limiting, referring to any ground-securing element that may be used in erecting the shelter 300, whether the securing element is a peg or another type of securing element. The rear pocket 150, which may be used to store items when the shelter 300 is pitched, may be used as the carrying bag for the article itself, the poles, and the pegs In certain embodiments, the carrying bag 500 may contain the article 100, four pegs (one to secure each corner of the shelter 300), and two foldable aluminum poles. The rear pocket 150 is formed of a soft polyester mesh that gives so as to easily receive the rest of the material of the article 100, the poles, and the pegs. FIGS. 1B, 3B, and 5A show the rear pocket 150 extending along the edge 104 of the article 100. Interior of the rear pocket 150, at its ends are tabs 152 that may be pulled to the exterior of the rear pocket 150 through the central opening 155 of the rear pocket to invert the rear pocket so that it may serve as a carrying bag into which the entire article, pole, and pegs may be stuffed. FIG. 5B shows the inverted rear pocket formed by pulling on the tabs 152 to bring them to outside of the rear pocket 150. The article 100 also has snap straps 157 for use in opening and closing the rear pocket 150. FIG. 5C shows the non-inverted rear pocket 150 with its snaps on the snap straps 157 opened so that the pocket is in readiness to transition from serving as a collar to serving as a carrying bag for receiving the rest of the article 100, the poles, and the pegs.

Once the bag is formed, the fabric of the article 100 and straps 124, 154 may be gathered up and stuffed evenly inside the inverted ends of the pocket 150 through the central opening 155; one collapsible pole and two pegs may be inserted into each pocket end to balance the load. The poles may be prevented from moving side to side in the bag 150 by inserting the pole ends into aside pocket, not shown.

The length of the rear pocket is sufficient to accommodate a collapsed pole in each of its ends and still be foldable in its middle into a V Shape. The stretchiness and bendability of the mesh from which the bag is formed allows the packed bag to still fold easily. Further, the V-shape into which the bag 500 may fold renders the bag less cumbersome to carry, even when the poles are packed therein. Further, the soft material from which the rear pocket is made and the soft material from which the rest of the article 100 packed into the bag provides cushioning between the poles and pegs and the individual carrying the bag.

Figure 5E:
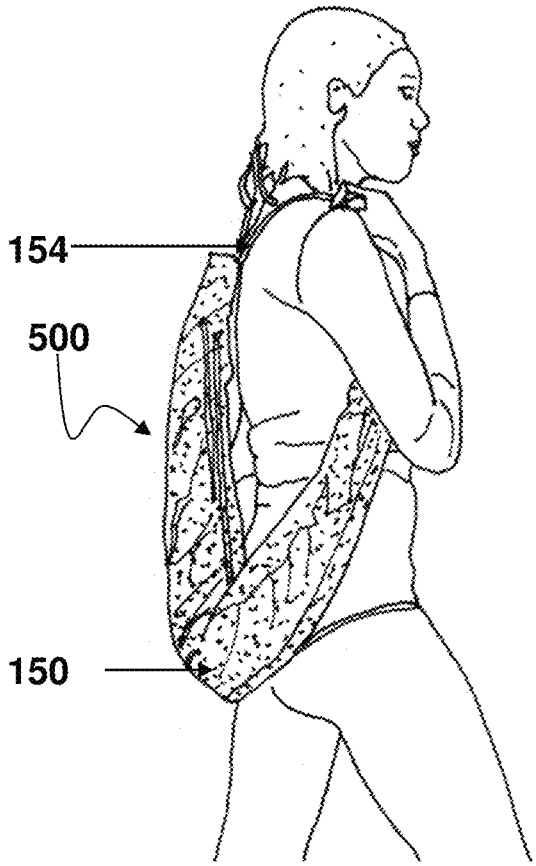
FIG. 5E is a side view of the carrying bag 500 as carried by a user.

It can be seen that the rear pocket is certainly multifunctional. Beside allowing the article to be packed and carried comfortably, when the article is assembled into a shelter, the mesh material from which the rear pocket is made provides not only a safe place for items to be handily stored, it allows the sand or dirt to drain away from the pocket. Further the rear pocket provides a soft, breathable, comfortable collar for the garment 600. The tabs 152 on the edges of the rear pocket 150 may be secured by closing the snaps on them to form a carrying strap 156. As shown in FIG. 5E, when packed up the bag 500 can be worn on the shoulder. The bag 500 may also be slung across the back as a cross body bag, or it may be attached around the waist as a fanny pack. In certain embodiments, the total weight of an article in its carrying bag 500, with pegs and poles, may be 2.5 pounds.

Garment 600

As shown in FIG. 6A-6G, the article 100 may also be transformed into a three-dimensional textile garment 600, which may be unisex and "one size fits all." As noted above, in certain embodiments, the article 100 may be formed of multiple densities of stretch panels, which offer high levels of sun protection designed into the surface thereof. In the embodiment shown in FIGS. 1A-1B, the stretch material is found in the rear panel 110 and the hood 140. The knit construction of the stretch panels fits the body when the article 100 is worn as a garment 600. The use of parabolic form in the pattern and cutting of article 100, which has been shown above to be useful in stabilizing the shelter 300, also provides comfort when worn as a garment 600, with parabolic seams and hyperbolic edges conforming to a person's silhouette when the article is being worn as a garment and with the stretchy material making it easy to keep arms inside and covered from sun exposure when the garment is worn as a cape or poncho entirely covering the entire arm from exposure to sun.

The rear pocket 150 of the article 100 may be formed of a soft polyester mesh that, when the article 100 operates as a garment, serves as a collar that drapes around the neck like a shawl.

Figure 6A:
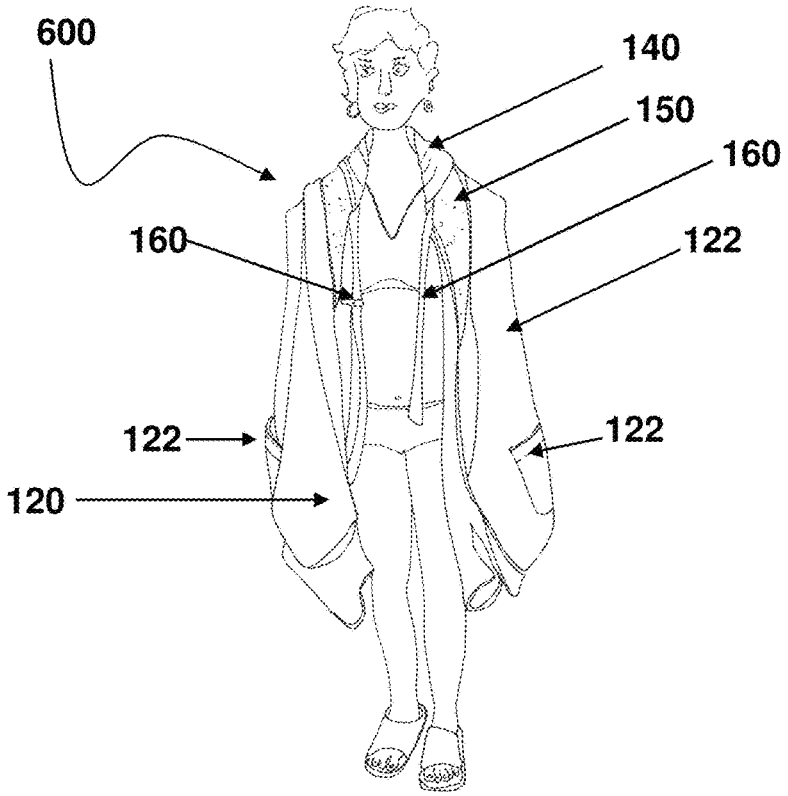
Figure 6B:
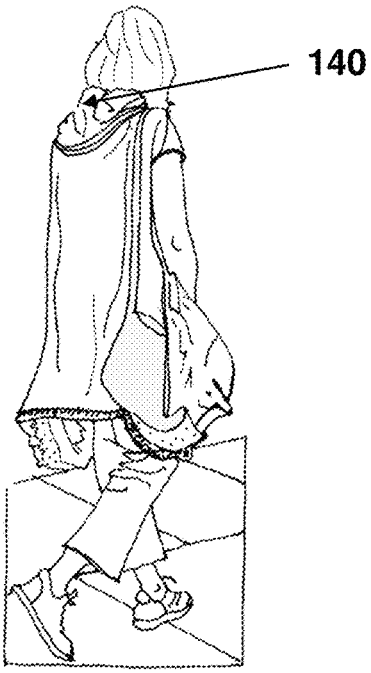
Figure 6C:
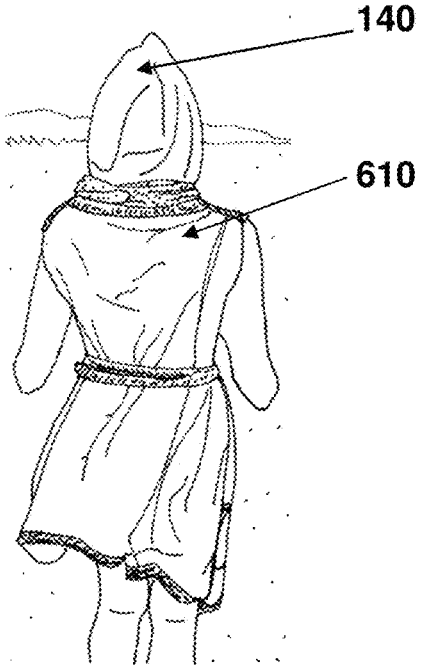

The article 100, when used as a garment, may be worn hooded as shown in FIG. 6C, or it may be worn unhooded as shown in FIGS. 6A and 6B. It also may be worn as a poncho or a cape, with arms within the garment as shown in FIG. 7A-7F or as a shell as shown in FIGS. 6A-6C, in which arms extended through the armhole slits allow for freedom to move and function while wearing the garment. Further, as shown in FIG. 6C, the garment may also be worn belted, in certain embodiments, with the top strap 154, also known as the hood strap 154, providing the belt by the first and second top straps ends of the hood strap 154 extending behind the wearer, in opposite directions crossing the back of the garment at the waist of the wearer, and extending to the front of the wearer, after which they may be secured to each other.

Figure 6D:
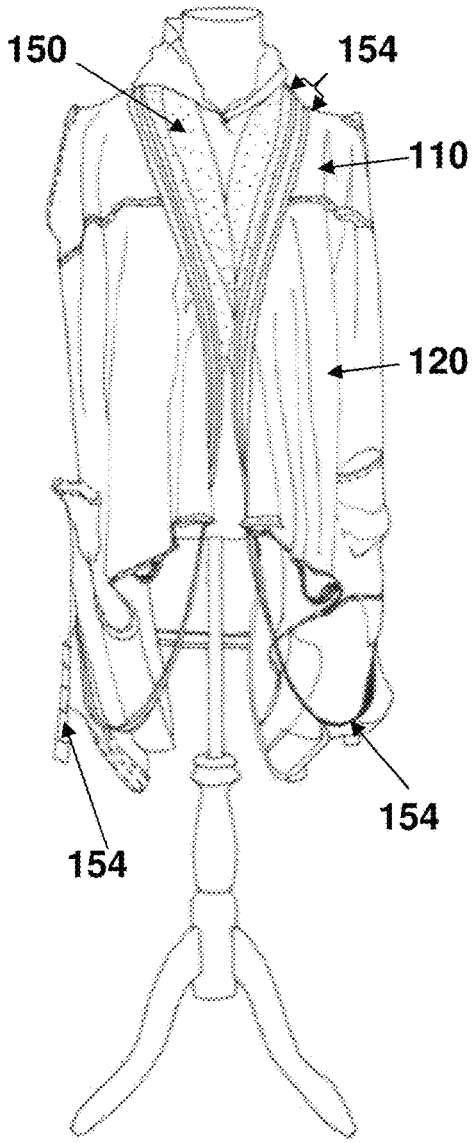
Figure 6E:
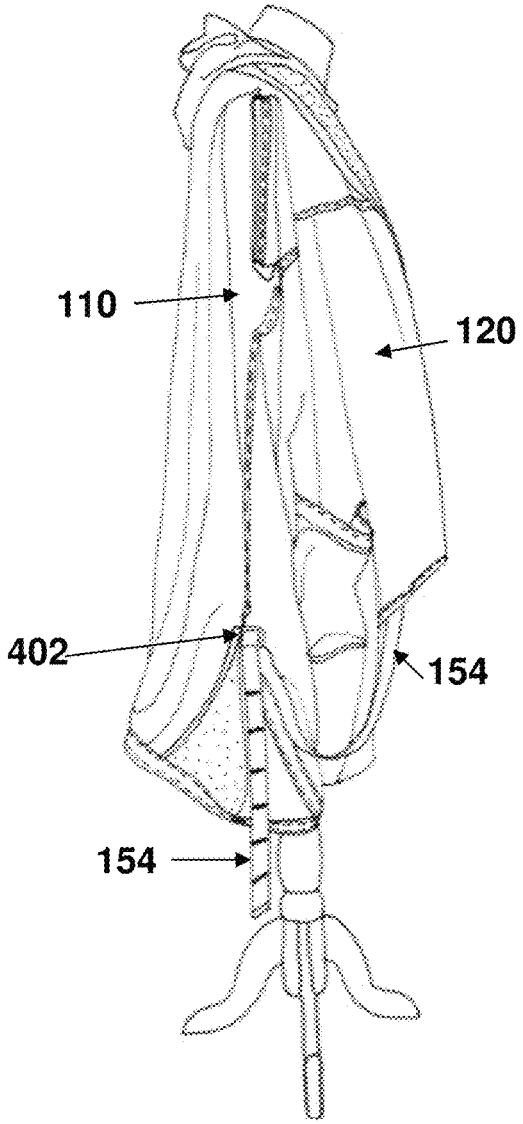
Figure 6F:
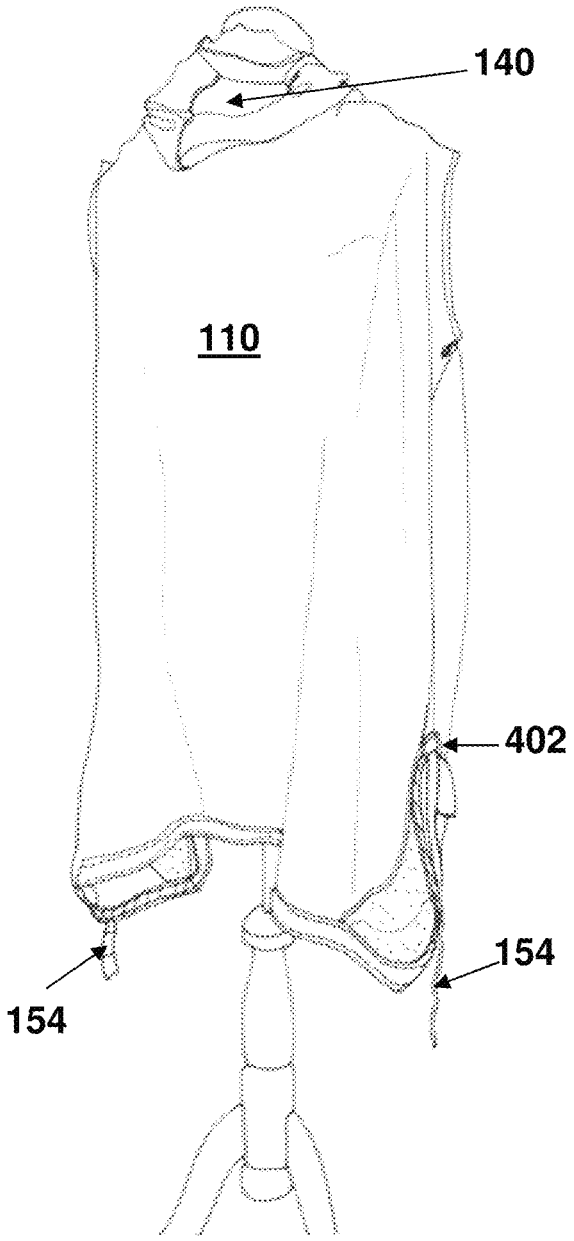

The shelter tiedown straps 124, 154 may be secured within the article when the article is worn like a garment. As shown in FIGS. 6D-6G, the securing of the bottom straps within the article 100 also operates to shorten portions of the garment 600. For example, as shown in FIGS. 6D-6F, the top strap 154, which is attached to the top edge 104, extends down the interior front of the garment 600 under the side panel 120. The top strap 154 may then be looped under the bottom edge of the side panel, and extended up to and through the D-ring 402 on the end of the bottom strap 124, which is disposed on the gusset 136 (lifting the first side panel front bottom corner and the second side panel bottom corner upward from the ground thus shortening the side panel 120). The top strap 154 may then be allowed to drop toward the ground.

Figure 6G:
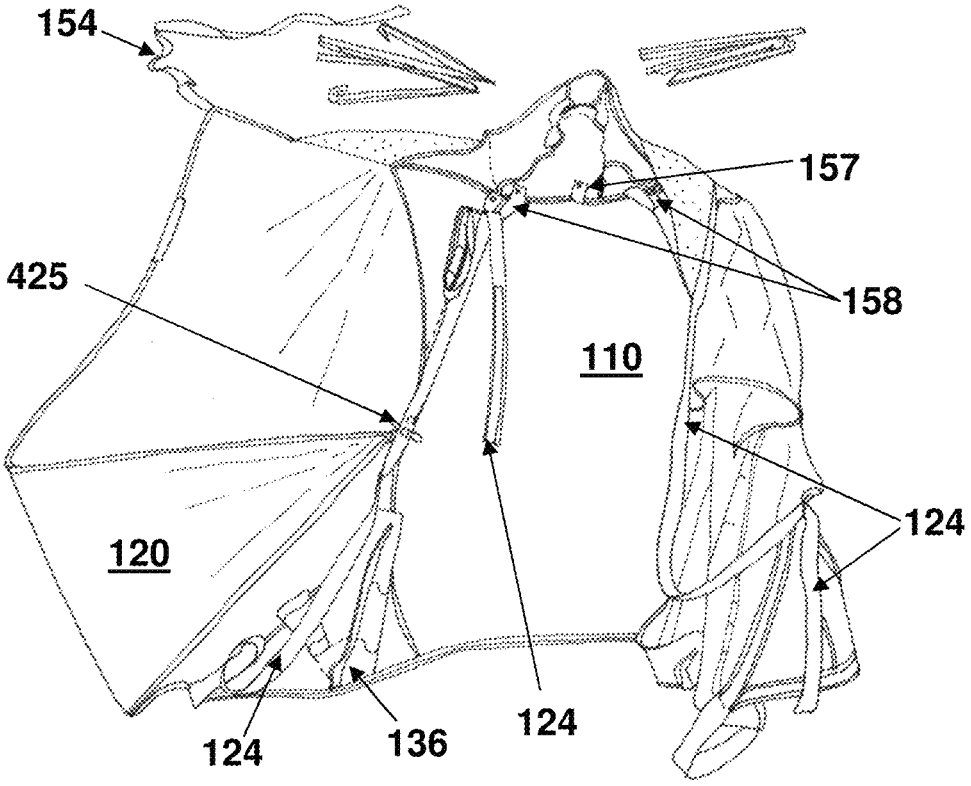

Further, as shown in FIG. 6G, a bottom strap 124, which is attached to a side panel 120 at the gusset 136, may be attached to the bottom corner of the side panel with the toggle 425 and loop 426, and then through the sleeve strap 158 on the interior back of the garment on the rear panel 110. The bottom strap 124 then may be allowed to drop toward the ground within the garment 600. By threading the bottom strap 124 through the sleeve strap 158, the length of the side panel in garment 600 may be made adjustable to accommodate wearers of varying heights.

Figure 7A:
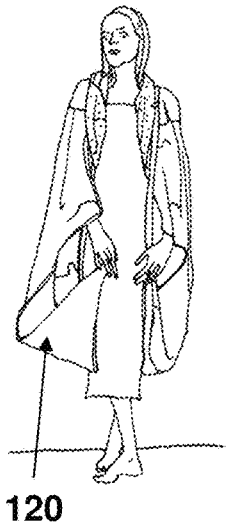
Figure 7B:
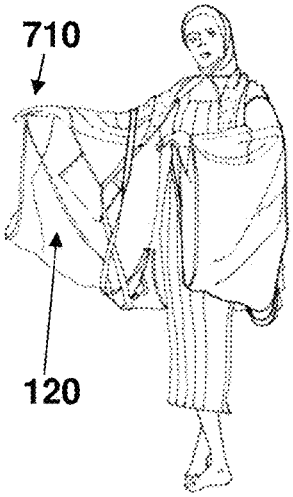
Figure 7C:
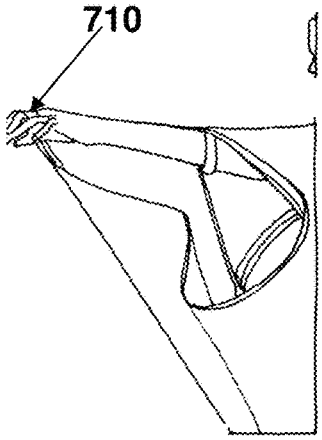

As shown in FIGS. 7A-7F, the garment 600 may be worn in a multitude of configurations. For example, the garment 600 may be worn as a hooded cape with the bottom corners of the side panels held up by a user. In FIGS. 7A-7C, the user is shown employing a handhold on the bottom corner of the side panel to shorten the side panel. The handhold 710 may be any convenient device, attached to or near the bottom corner of the side panel, such as a toggle, button, a hole such as a button hole, loop or a D-ring. One suitable handhold is the loop 426 shown in FIG. 4F as positioned on the side panel bottom corner to go around the toggle 425.

Figure 7D:
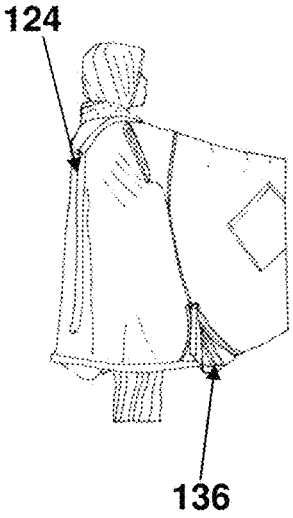
Figure 7E:
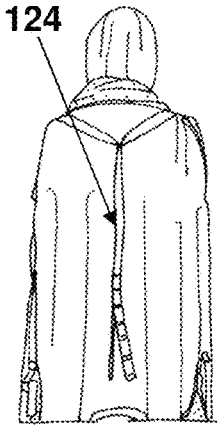
Figure 7F:
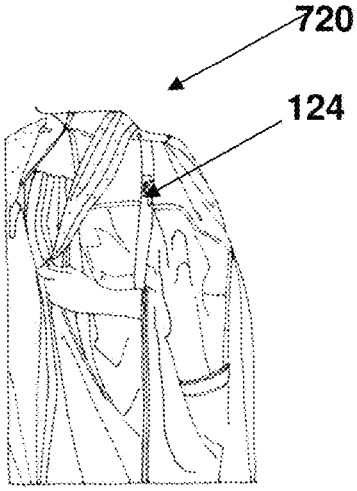

As noted above, when the article is worn as a garment 600, the length of the side panels may be controlled by securing the straps 124, 154. FIG. 7D-7F illustrate an alternative method for securing the bottom straps 124 when the article 100 is used as a garment 600. The bottom strap 124 may be attached to the bottom corner of the side panel using a toggle and loop system shown in FIG. 4F, and the sleeve strap 158 may be disposed through the arm slit from the interior of the garment and snapped to exterior top of the garment to form a first loop and second loop and operate as an epaulet.

As shown in FIG. 7F, the bottom straps 124 may then be threaded through the sleeve strap 158, and moved to the back exterior of the garment 600, where, as shown in FIGS. 7D and 7E, they may be joined to each other (knotted or, as shown, snapped) across the rear panel 110. The loose ends then may be allowed to drape down the back of the garment 600.

Also as noted above, in certain embodiments, the poles and pegs, useful when the article 100 is pitched as a shelter, may be stored in the garment. In the illustrative but not necessarily preferred embodiment of FIG. 6A, the poles and pegs may be stored in either side of the rear pocket 150, which forms the collar of the garment 600. Alternatively, collapsible poles and pegs may be stored in a pocket, not shown, along the hemline of the garment 600 or down the side edge of one or more of the side panels. The poles may also be stored in a user's beach bag, or, as shown in FIG. 9F, used as walking sticks.

Also, as noted above the garment may be provided with sleeves to provide a user's shoulders with additional protection from over-exposure to the sun. As shown in FIGS. 8A-8F, the garment 600 may have armhole slits 112 positioned in the rear panel where the user's shoulder would fall when the article 100 is worn as garment 600. The arms slits 112 allow the wearer to extend his or her arm out of the garment, thus forming the garment into a shell rather than a cape. Sleeve extensions may be provided to the armhole slits 112 to form sleeves to protect a wearer's shoulders and at least a portion of the arm from the sun. While the style of sleeve is at the choice of the designer, in the illustrative but not necessarily preferred embodiment shown in FIGS. 8A-8F, the garment 600 is fitted with cap sleeves 812. Other suitable sleeve styles include, without limitation, bell, raglan, or dolman sleeves. In certain embodiments, the sleeves may also function as a top strap.

Figure 8A:
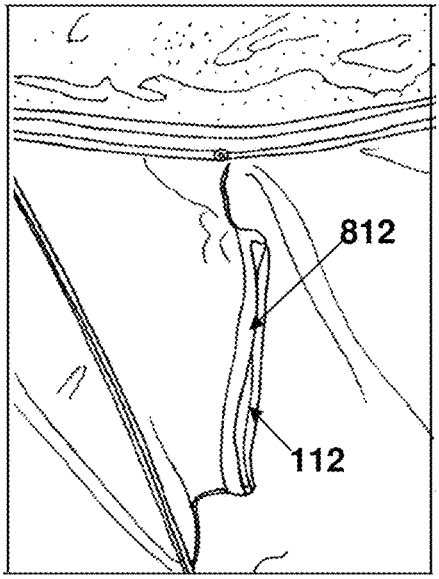
Figure 8B:
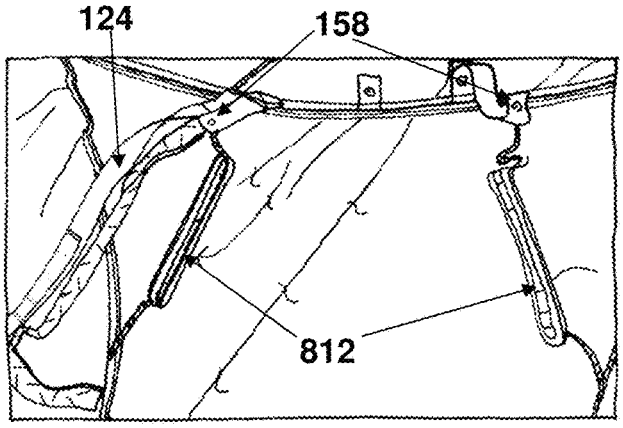

In an illustrative but not necessarily preferred embodiment of FIG. 8A, both sides of the rear panel are provided with a cap sleeve 812. Sleeves may be formed in the article 100 in any conventional manner. In one construction of the illustrative but not necessarily preferred embodiment of FIG. 8A, the pattern of the rear panel may be shaped to have half of a sleeve, to allow for a piece of material also shaped as half of a sleeve, to be sewn thereon so as to form a sleeve in the upper corner of the rear panel. In another construction of the illustrative but not necessarily preferred embodiment of FIG. 8A, the pattern of the rear panel may be formed, for example, with a slit to allow for one or more pieces of material shaped to form a sleeve to be sewn thereon so as to form a sleeve in the top corner of the rear panel. In the embodiment shown in FIG. 8A-8F, the sleeve may be a cap sleeve 812 extending from the rear panel along or near its upper corner.

Sleeve extensions, no matter how formed, may be provided not only to protect a wearer's shoulders from the sun, but also to operate as gussets to provide additional give to the fabric at the shoulder of the rear panel when the article 100 is used as a garment 600.

Figure 8C:
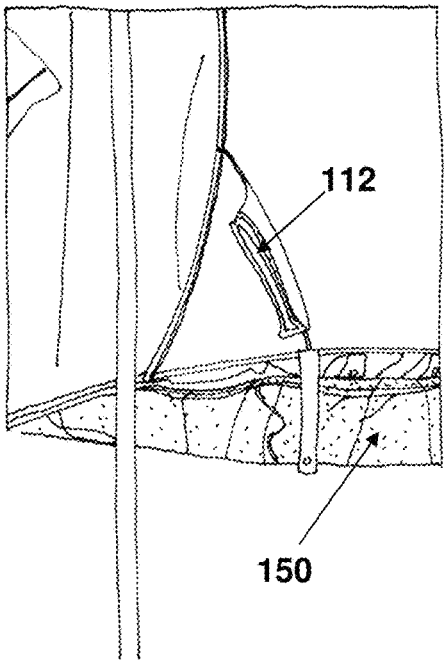
Figure 8D:
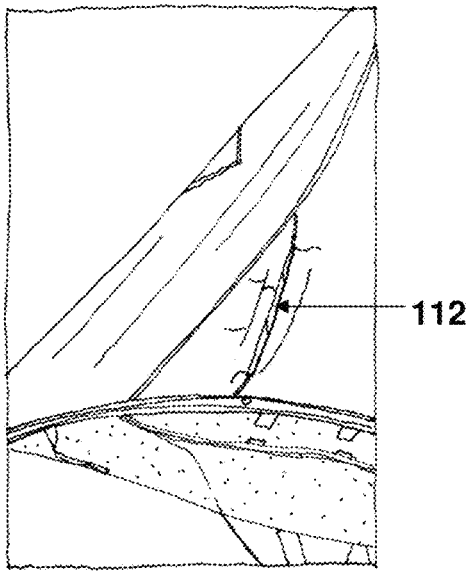

As shown in FIGS. 8C and 8D, when the article 100 is pitched as a shelter, the vertical tensioning of the stretch material of the rear panel 110 flattens and closes the armhole slits 112, preventing sun from getting through the material of the rear panel. Further, under vertical tensioning of the stretch material, the sleeve extensions fold on themselves against the material of the rear panel, reinforcing the closure of the arm slits 112 against the sun.

Figure 8E:
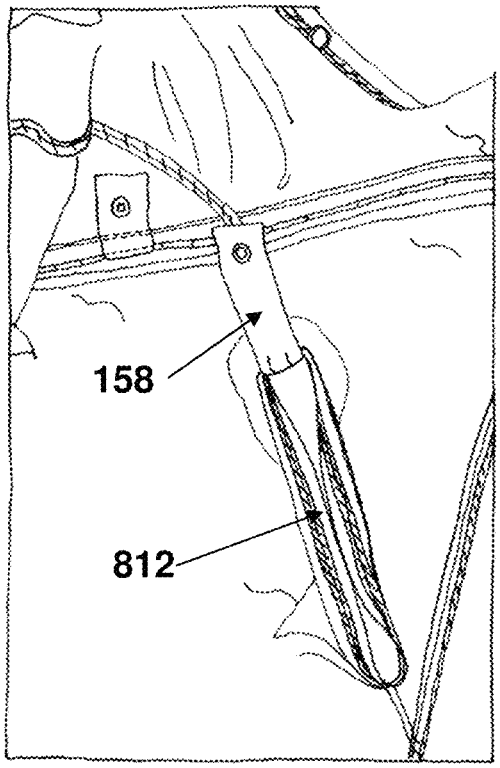
Figure 8F:
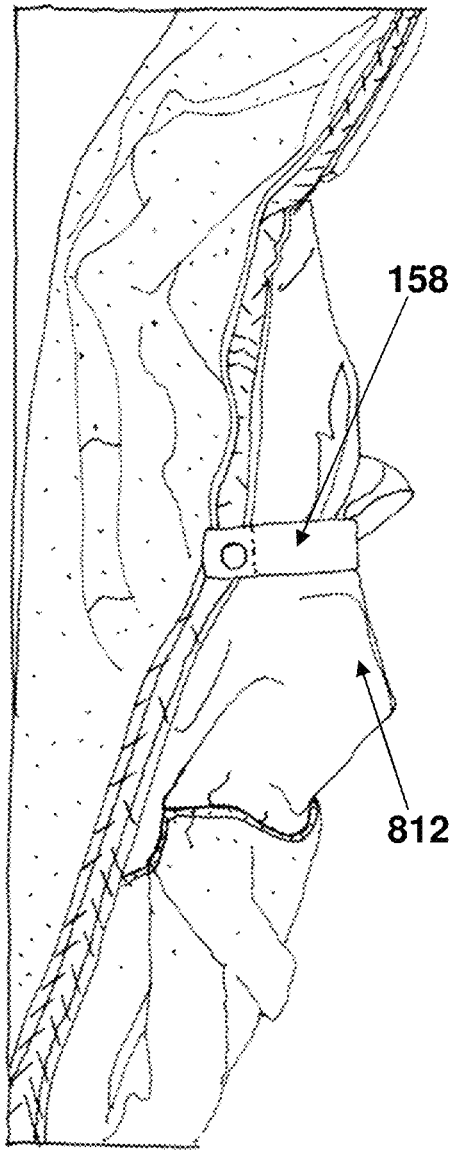

In certain embodiments, such as shown in FIGS. 1A, 5C, 6G, 8B, 8E, and 8F, the article 100 also may have sleeve straps 158 for use in gathering a sleeve such as cap sleeve 812 to render a garment 600, such as one shown in FIGS. 8E and 8F, sleeveless. The sleeve straps 158 may be attached (sewn) to one side (such as an interior side) of the top edge of the rear panel and corresponding snaps may be attached (sewn or pressed) to the other side (such as an exterior side) of the top edge of the rear panel to capture the cap sleeve material when a strap 158 is extended from the interior of the garment to the exterior through the slit 112 and then secured (snapped) closed to its corresponding snap so that the garment may be worn sleeveless.

Figure 9A:
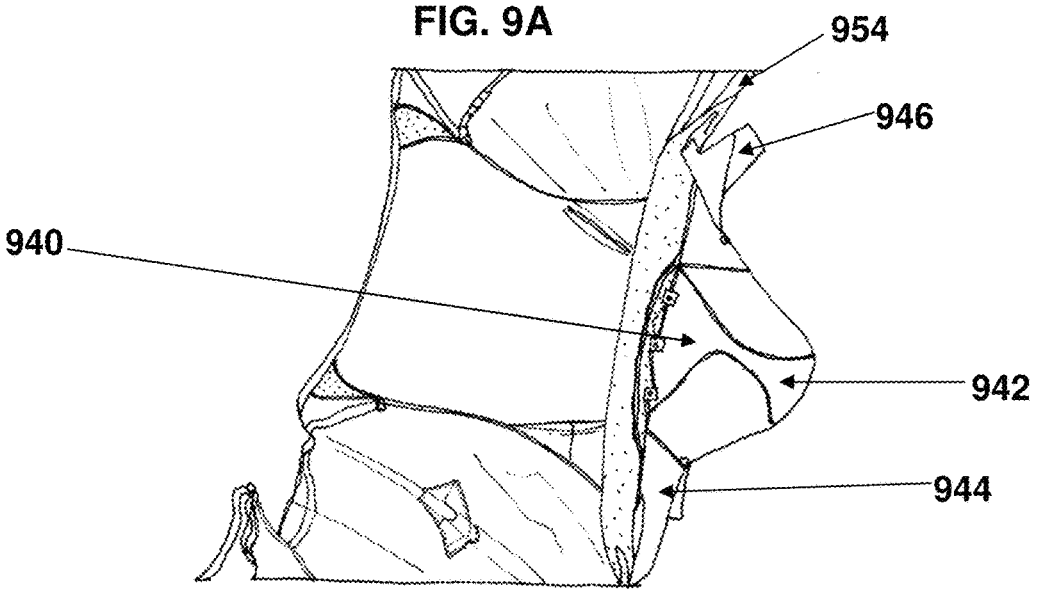
Figure 9B:
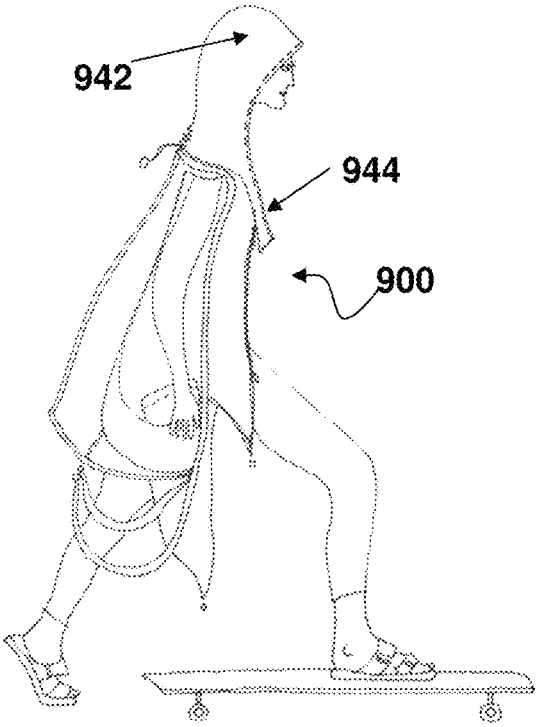
Figure 9C:
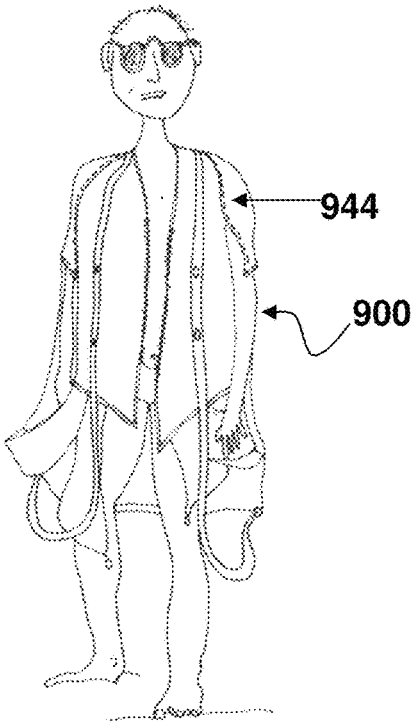
Figure 9D:
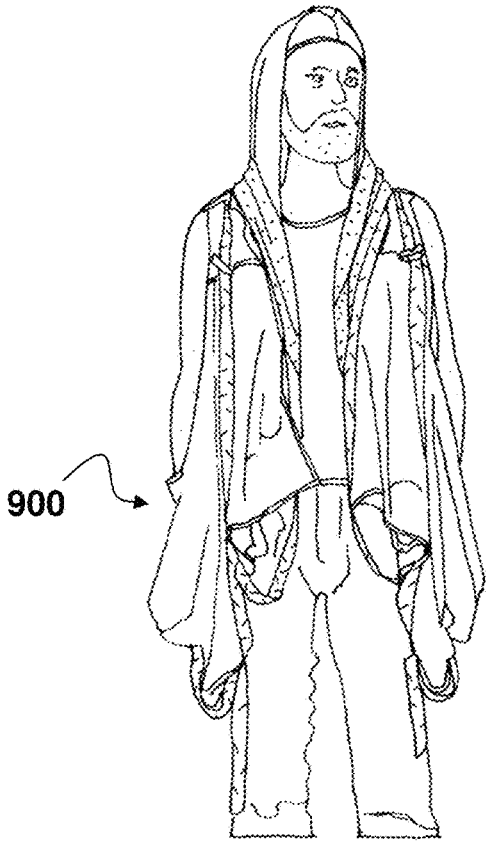
Figure 9E:
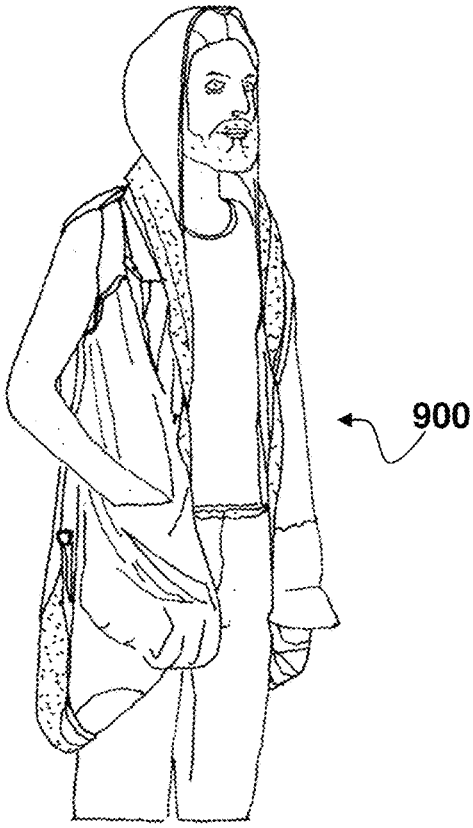
Figure 9F:
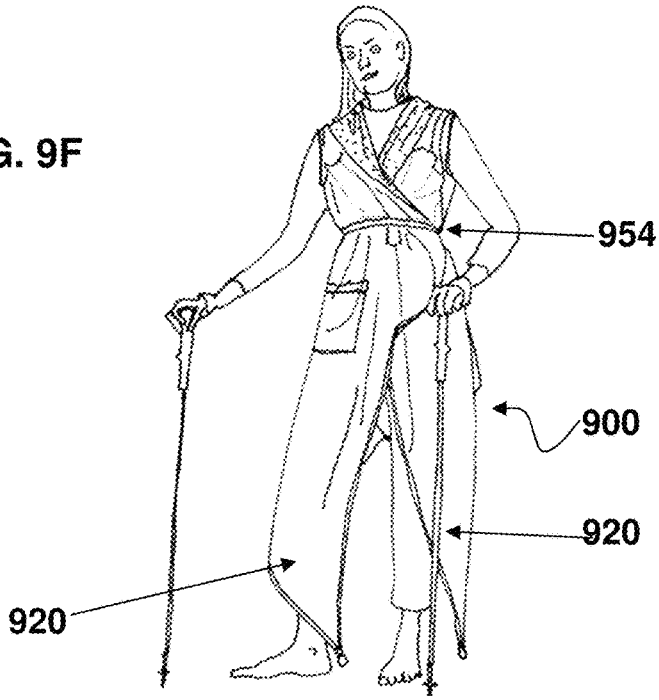

In another embodiment of the multi-functional sun protection article, a garment 900 is shown in FIGS. 9A-9F, in which a hood 940 attached to a top edge of a sun protection article provides additional sun protection. The hood 940 may have an upper hood 942 and hood extensions 944 on either side of the upper hood. The hood extensions 944 may have closure elements 946 at their ends. When the garment is worn by a user, as shown in FIG. 9B, the closure elements 946 may attach to each other around the user's neck, simultaneously securing the hood to the user's head and protecting the user's neck from over-exposure to the sun. When the garment 900 is worn unhooded, the hood extensions 944 may drape over the user's shoulders, protecting the user's shoulders from over-exposure to the sun.

More detail of the garment as worn by users are shown generally in FIGS. 9D-9F. As shown in FIG. 9F, the garment 900, worn as an unhooded shell by a user with one side panel extending over the other side panel, has the top strap 954 used as a belt on the garment, with the side panels extending unfolded downward, and with the user using the shelter support poles as walking sticks.

Advantages

It can be seen that the multi-functional sun protection article disclosed here provides many advantages over conventional sun protection systems. For example, the sun protection article, presenting a simple design, is easily and efficiently transformed to provide sun protection in more than one mode. Finally, it can be seen that the disclosed wearable shelter structure is arranged to provide simple, and efficient protection from sun exposure for a user but provide a convenient, efficient attractive manner for transporting the shelter as a bag or as a garment worn by the user. The multi-functional sun protection article disclosed here is particularly advantageous to individuals who enjoy the out-of doors but do not want to carry several single purpose protection systems each time they venture outside. For example, hunters, beach-goers, park-hikers, bicyclists, backpackers, and parents with small children. The disclosed multi-functional sun protection article would even be useful in a person's backyard.

The foregoing descriptions have been presented for purposes of illustration. It is not exhaustive and does not limit the invention to the precise forms or embodiments disclosed. Modifications and adaptations of the invention will be apparent to those skilled in the art from consideration of the specification and practice of the disclosed embodiments. For example, although the embodiments herein are described in the context of providing protection from over-exposure to the sun, they are also useful in providing protection from all kinds of weather elements, including wind, rain, snow, sun, heat, and cold. Therefore, in this application, the term "sun" is non-limiting, referring to any force, particularly weather element, that may be detrimental to an individual's comfort when the individual is over-exposed to the force.

Another example of the potential modifications and adaptations of the invention described here include making the hood attachable and removable, for example, by snaps or zipper. Further, instead of sewing additional pieces of material to form a sleeve, a designer may choose to create a batwing sleeve using corresponding extensions of material on a rear panel and a side panel to form the sleeve. In addition, the bottom straps 124 could be replaced by a single bottom edge strap that extends across the entire bottom edge of the article 100. Another modification may be shown in the shelter 450 of FIG. 4H-1, shown in more detail in FIG. 4H-2, which has a visor disposed along the bottom edge 402 of the article from which the shelter 450 is assembled. The visor 452, which may be made of polyester heavy athletic mesh (the weave of which may assist in stabilizing the knit), may extend along and be attached to the bottom edge of the article and be arranged to cover at least a portion of the gusset, over the pole tip point 435 of the peaks, and across the rear panel near the lower edge 120 of the article from gusset to gusset to provide the shelter's inhabitants with additional protection from over-exposure to the sun.

Figure 3A:
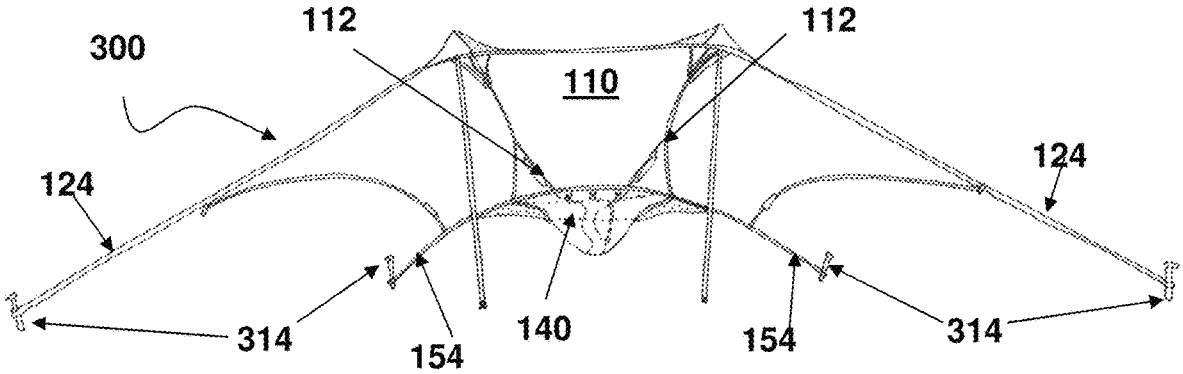
FIG. 3A is a perspective view of the interior of the article 100 assembled into a shelter structure 300.
Figure 3B:
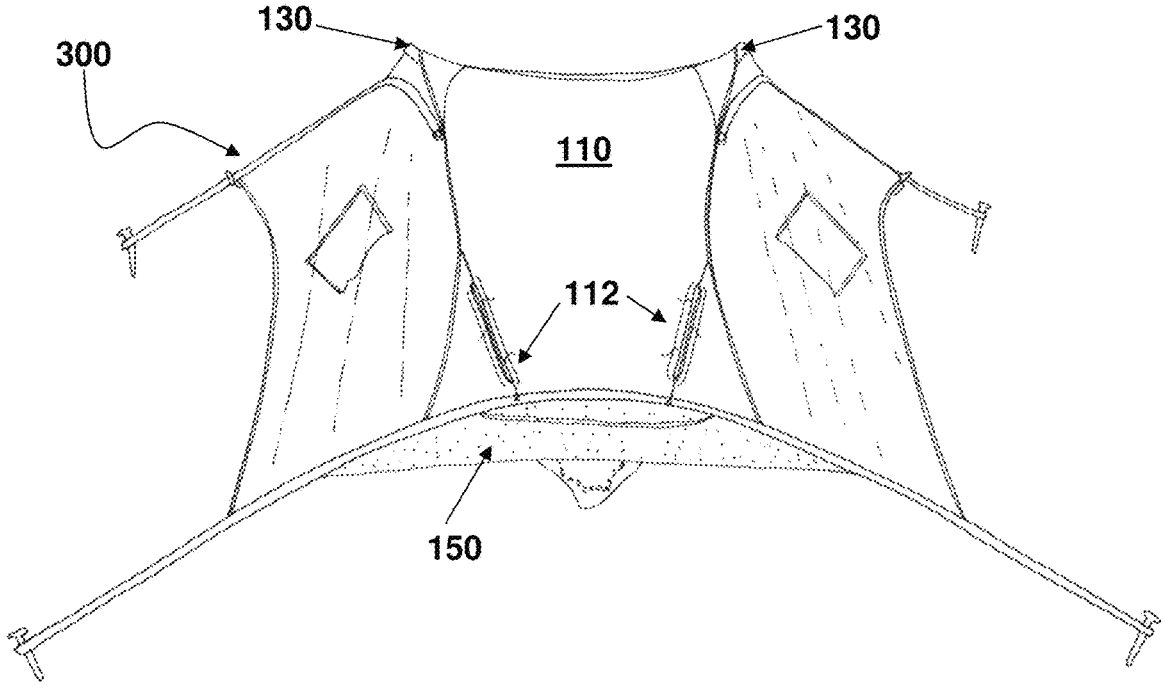
FIG. 3B is a perspective view of the exterior of the assembled shelter structure 300, illustrating a pair of peaks 130 with poles inserted.

As another example, in alternative embodiments, the support poles shown in FIGS. 3A and 3B may be replaced with any suitable support systems, including but not limited to inflatable airbeams, which may be substituted for poles for erecting the shelter. Airbeams, occasionally referred to as inflatable pole supports, may serve as rigid structural supports when inflated but are soft and pliable when deflated. Typically, airbeams are formed of a highly dimensionally stable (i.e. no stretch) fabric sleeve and an air-holding inner bladder. Using airbeams as supports in the assembled shelter eliminates the need to carry poles or store them in the garment or carrying bag.

Although the disclosed components have been described above as being separate units, one of ordinary skill in the art will recognize that functionalities provided by one or more units may be combined. For example, a designer may use a pair of straps to operate as both the sleeve straps and snap straps. As one of ordinary skill in the art will appreciate, one or more units may be optional and may be omitted from implementations in certain embodiments. For example, in another embodiment of the garment, a hood may be completely omitted from the article 100; and, in certain embodiments, the bottom straps 124 may be sewn to the bottom edge of the side panels in order to eliminate a set of toggles 425.

In addition, one skilled in the art will appreciate that although only one or two of the components identified above is depicted in the Figures, any number of any of these components may be provided, and that functions provided by one or more components of any of the disclosed systems may be combined or incorporated into one or another component shown in the Figures. For example, another embodiment of the shelter structure may feature a single peak to form a teepee-style shelter.

It is intended that the specification and examples be considered as exemplary only, with a true scope and spirit of the invention being indicated by the following claims.

The invention claimed is:

1. A multi-functional article comprising:

a bottom edge, a top edge, and a rear panel extending from the bottom edge to the top edge, the rear panel formed from a first stretchy material;

a pair of side panels extending from the bottom edge to the top edge, further comprising a first side panel having a first side panel attached edge, which is attached to a first side edge of the rear panel, and a first side panel front edge opposite to the first side panel attached edge, wherein the first side panel front edge extends from the top edge of the multi-functional article to the bottom edge of the multi-functional article, and wherein the first side panel has a first side panel front bottom corner disposed between the first side panel front edge and the bottom edge of the multi-functional article, and a second side panel having a second side panel attached edge, which is attached to a second side edge of the rear panel, and a second side panel front edge opposite to the second side panel attached edge, wherein the second side panel front edge extends from the top edge of the multi-functional article to the bottom edge of the multi-functional article, and wherein the second side panel has a second side panel front bottom corner disposed between the second side panel front edge and the bottom edge of the multi-functional article;

wherein the multi-functional article further is capable of use as a garment and a shelter structure for at least one individual, the multi-functional article further comprising:

a peak disposed on the multi-functional article near or along the bottom edge, the peak having a gusset and a cushioned socket formed from a second stretchy material and arranged to receive a pole for supporting the multi-functional article when the multi-functional article is assembled into the shelter structure and also arranged to lay flat on an interior surface of a garment when the multi-functional article is worn as the garment;

an invertible rear pocket disposed across the top edge of the multi-functional article, wherein the rear pocket is sized and arranged;

to hold items when the multi-functional article is erected into the shelter structure, to serve as a collar when the multi-functional article is worn as the garment, and to contain the multi-functional article for storage thereof when the multi-functional article is not in use as the shelter structure or the garment;

a top strap arranged and sized to secure the multi-functional article to the ground when the multi-functional article is erected into the shelter structure and to operate as a belt when the multi-functional article is worn as the garment, wherein the top strap is secured to the first side panel, the rear panel, and the second side panel at the top edge of the multi-functional article, and wherein the top strap has a first top strap end that is attached to a first top transition location positioned on the top edge on or near the first side panel, and extends freely away therefrom, and a second top strap end that is attached to a second top transition location positioned on the top edge on or near the second side panel, and extends freely therefrom; and a pair of bottom straps arranged and sized to secure the multi-functional article to the ground when the multi-functional article is erected into the shelter structure and to shorten the side panels when the multi-functional article is worn as the garment, wherein the pair of bottom straps has:

a first bottom strap secured to the first side panel at the bottom edge of the multi-functional article, the first bottom strap having a first bottom end permanently or releasably attachable to the first side panel front bottom corner and extending freely away therefrom, and a second bottom strap secured to the second side panel at the bottom edge, the second bottom strap having a second bottom end permanently or releasably attachable to the second side panel front bottom corner of the second side panel and extending freely away therefrom.

2. The multi-functional article of claim 1, further comprising a stabilizing strap attached along the bottom edge of the multi-functional article between the pair of bottom straps, the stabilizing strap arranged to counteract pulling forces exerted against the peak by the bottom straps and the pole when the multi-functional article is erected into the shelter structure.

3. The multi-functional article of claim 1, further comprising a visor extending along and attached to the bottom edge of the multi-functional article and arranged to provide additional protection from over-exposure to sun.

4. The multi-functional article of claim 1, wherein the rear panel is formed of a stretch knit material.

5. The multi-functional article of claim 1, wherein the side panels are formed of a woven material.

6. The multi-functional article of claim 1, wherein the rear pocket further comprises at least one graspable tab disposed in the interior of the rear pocket, the at least one tab arranged to be pulled to the exterior of the rear pocket to facilitate inversion of the rear pocket.

7. The multi-functional article of claim 1, wherein the cushioned socket is formed of a plurality of layers of cushioning material.

8. The multi-functional article of claim 1, wherein the cushioned socket further comprises:

a point of contact within the cushioning socket arranged to receive a tip of the pole when the pole is received within the cushioning socket, and an empty space between the peak and the point of contact to provide additional cushioning between the pole and the peak.

9. The multi-functional article of claim 1, further comprising a first slit and second slit, the slits disposed in or near top corners of the rear panel and sized and positioned to allow a wearer's arms to pass therethrough when the multi-functional article is worn as a garment.

10. The multi-functional article of claim 1, wherein the rear panel has a selected length at the top edge between a first point of attachment of the rear panel to the first side panel and a second point of attachment of the rear panel to the second side panel, and wherein the top strap is affixed at the top edge of the multi-functional article along the selected length of the rear panel.

11. The multi-functional article of claim 10, wherein the top strap is affixed at the top edge of the multi-functional article:

from the first point of attachment to the first top transition location, and from the second point of attachment to the second top transition location.

12. The multi-functional article of claim 1, wherein the first bottom strap is secured to the first side panel on the bottom edge at the first side panel front bottom corner and at a selected first side panel bottom location positioned near a base of the peak, with the first bottom strap extending between the first side panel front bottom corner and the selected first side panel bottom location along but unattached to the bottom edge; and wherein the second bottom strap is secured to the second side panel on the bottom edge at the second side panel front bottom corner and at a selected second side panel bottom location positioned near the base of the peak, with the first bottom strap extending between the second side panel front bottom corner and the selected second side panel bottom location along but unattached to the bottom edge.

13. The multi-functional article of claim 1, wherein the first side panel is arranged to be extendable over the second side panel when the multi-functional article is worn as the garment, and wherein the first top strap end and the second top strap end are arranged to be extendable around a wearer of the garment near a waist of the wearer and to be secured together to form the belt.

14. The multi-functional article of claim 1, further comprising a hood attached to the top edge of the multi-functional article and sized to contain a wearer's head.

15. The multi-functional article of claim 14, wherein the hood is formed from a stretchy material.

16. The multi-functional article of claim 14, wherein the hood further comprises an upper hood and hood extensions on either side of the upper hood, the hood extensions arranged, when the hood is not being worn on the wearer's head, to drape over the wearer's shoulders to provide protection from over-exposure to the sun.

17. The multi-functional article of claim 1, wherein the multi-functional article further comprises technology fitted thereto for collection of power for charging devices or for monitoring time exposure to ultra-violet radiation.

18. A method comprising:

assembling a multi-functional article into a garment, wherein the multi-functional article has:

a body with a bottom edge, a top edge, a rear panel, and side panels attached to side edges of the rear panel, with the body having an interior surface that operates as an interior of the garment and as an interior of the shelter structure, and with the side panels extending from the bottom edge to the top edge, and further comprising a first side panel having a first side panel attached edge, which is attached to a first side edge of the rear panel, and a first side panel front edge opposite to the first side panel attached edge, wherein the first side panel front edge extends from the top edge of the multi-functional article to the bottom edge of the multi-functional article, and wherein the first side panel has a first side panel front bottom corner disposed between the first side panel front edge and the bottom edge of the multi-functional article, and a second side panel having a second side panel attached edge, which is attached to a second side edge of the rear panel, and a second side panel front edge opposite to the second side panel attached edge, wherein the second side panel front edge extends from the top edge of the multi-functional article to the bottom edge of the multi-functional article, and wherein the second side panel has a second side panel front bottom corner disposed between the second side panel front edge and the bottom edge of the multi-functional article;

an invertible rear pocket extending along at least a portion of the top edge that operates as a collar of the garment, as the rear pocket for the shelter structure, and, when inverted, as a carrying case for storing the multi-functional article when the multi-functional article is not in use as the shelter structure or the garment;

a top strap secured to the first side panel along the top edge, wherein the top strap has a first top strap end that is attached to a first top transition location positioned on the top edge and extends freely away therefrom, and a second top strap end that is attached to a second top transition location positioned on the top edge and extends freely away therefrom; and length adjustment straps having:

a first bottom strap secured to the first side panel at the bottom edge of the multi-functional article, the first bottom strap having a first bottom end permanently or releasably attachable to the first side panel front bottom corner and extending freely away therefrom, and a second bottom strap secured to the second side panel at the bottom edge, the second bottom strap having a second bottom end permanently or releasably attachable to the second side panel front bottom corner of the second side panel and extending freely away therefrom; and wherein the assembling the multi-functional article into the garment further comprises:

forming a belt with the top strap by extending the first top strap end and the second top strap end around a wearer of the garment near a waist of the wearer, and securing the first top strap end to the second top strap end; and adjusting a distance from the ground of at least one of the side panels by lifting the first side panel front bottom corner upward from the ground;

assembling the multi-functional article into a shelter structure, further comprising:

when the multi-functional article is being worn as the garment by a user, removing the multi-functional article from the user's body, or when the multi-functional article is being stored in the invertible rear pocket, removing the multi-functional article from the invertible rear packet;

constructing a peak on the interior surface of the body at a desired location near or along the bottom edge, wherein the constructing further comprises selecting the desired location to ensure that the shelter structure has tensional integrity when the shelter structure is assembled and counteracting forces applied by components of the shelter structure and by weather conditions are in balance; and forming the peak with a flat, planar construction and of a first stretchable and cushioning material to ensure that a pole is firmly but flexibly positioned within the peak at the desired location when the multi-functional article is in use as the shelter structure and to ensure that the peak lays generally flat on the interior surface of the body when the multi-functional article is not in use in an assembled shelter structure;

holding items within the shelter structure in the rear pocket; and securing the shelter structure to the ground with the garment belt and the length adjustment straps, and inverting the rear pocket to form the carrying bag for storing the multi-functional article when the multi-functional article is not in use as the shelter structure or not being worn as the garment.

19. The method of claim 18, wherein assembling the multi-functional article into a garment further comprises storing the pole in a pocket extending along a hemline of the garment or extending down a side edge of one or more of the side panels.

20. The method of claim 18, wherein forming the peak further comprises:

forming a flat peak socket of a second stretchable and cushioning material, and attaching the flat peak socket to the interior surface at the desired location.

21. The method of claim 20, wherein forming the flat peak socket further comprises:

selecting a point of contact within the flat peak socket to receive a tip of the pole when the pole is positioned within the flat peak socket; and constructing an empty space within the flat peak socket between desired location and the point of contact.

22. The method of claim 21, wherein constructing the empty space further comprises constructing the flat peak socket with a generally triangular cushioned shape with an opening on a first side to receive the pole, and a second side for attaching the flat peak socket to the interior surface along a line that approaches and points to the desired location; and stitching a line of reinforcing stitching across the flat peak socket, with the reinforcing stitching applied generally perpendicular to the second side or a third side of the flat peak socket at or near the point of contact.

23. The method of claim 18, wherein lifting the first side panel front bottom corner further comprises attaching at least one handhold element to or near the bottom corner of the first side panel for a wearer to hold.

24. The method of claim 18, wherein adjusting the distance from the ground of at least one of the side panels further comprises lifting the second side panel front bottom corner upward from the ground, and wherein lifting the first side panel front bottom corner and the second side panel front bottom corner upward from the ground comprises:

disposing a first loop and a second loop on the multi-functional article on the rear panel at or near the top edge and near the first side panel and the second side panel, respectively, threading the first bottom strap and the second bottom strap through first loop and the second loop, respectively, and joining the first bottom strap and the second bottom strap together.

25. A shelter system comprising an assembly of at least one shelter structure arranged to shelter at least one individual, with the shelter structure constructed from a multi-functional article that is also capable of being worn as a garment, wherein the multi-functional article has:

a bottom edge, a top edge, and a rear panel extending from the bottom edge to the top edge, the rear panel formed from a first stretchy material;

a pair of side panels further comprising a pair of side curtains and extending from the bottom edge to the top edge, further comprising:

a first side panel having a first side panel attached edge, which is attached to a first side edge of the rear panel, and a first side panel front edge opposite to the first side panel attached edge, wherein the first side panel front edge extends from the top edge of the multi-functional article to the bottom edge of the multi-functional article, and wherein the first side panel has a first side panel front bottom corner disposed between the first side panel front edge and the bottom edge of the multi-functional article, and a second side panel having a second side panel attached edge, which is attached to the second side edge of the rear panel, and a second side panel front edge opposite to the second side panel attached edge, wherein the second side panel front edge extends from the top edge of the multi-functional article to the bottom edge of the multi-functional article, and wherein the second side panel has a second side panel front bottom corner disposed between the second side panel front edge and the bottom edge of the multi-functional article;

a peak disposed on the multi-functional article near or along the bottom edge, wherein the peak has a gusset and a cushioned socket formed from a second stretchy material and arranged to lay flat on an interior surface of the multi-functional article, and to receive a pole for supporting the multi-functional article when the multi-functional article is assembled into a shelter structure;

an invertible rear pocket sized to operate as a collar of the garment, as the rear pocket for the shelter structure, and, when inverted, as a carrying case for storing the multi-functional article when the multi-functional article is not in use as the shelter structure or the garment, a top strap arranged and sized to secure the multi-functional article to the ground when the multi-functional article is erected into the shelter structure, wherein the top strap is secured to the first side panel, the rear panel, and the second side panel at the top edge of the multi-functional article, and wherein the top strap has a first top strap end that is attached to a first top transition location positioned on the top edge and extends freely away therefrom, and a second top strap end that is attached to a second top transition location positioned on the top edge and extends freely away therefrom; and a pair of bottom straps arranged and sized to secure the multi-functional article to the ground when the multifunctional article is erected into the shelter structure, wherein the pair of bottom straps has:

a first bottom strap secured to the first side panel at the bottom edge, the first bottom strap having a first bottom end permanently or releasably attachable to the first side panel front bottom corner and extending freely away therefrom, and a second bottom strap secured to the second side panel at the bottom edge, the second bottom strap having a second bottom end permanently or releasably attachable to the second side panel front bottom corner and extending freely away therefrom.

26. The shelter system of claim 25, wherein the at least one shelter structure comprises a plurality of shelter structures, and wherein the assembly further comprises a linked assembly of the plurality of shelter structures that are formed from a plurality of multi-functional articles, in which, when the plurality of multi-functional articles are erected into the plurality of shelter structures:

peaks of adjacent erected shelter structures overlap, with a peak of a first erected shelter structure overlapped by a peak of a second erected shelter structure;

side curtains of the adjacent shelter structures overlap, with one of the side curtains of the first erected shelter structure overlapped by one of the side curtains of the second erected shelter structure; and one of the secured bottom straps of the first erected shelter structure is positioned under one end of the secured top strap of the second erected shelter structure.

27. The shelter system of claim 26, wherein the erected shelter structures are formed into a line having a beginning shelter structure and a final shelter structure.

28. The shelter system of claim 25, further comprising a first linking strap positioned on an exterior surface of a first erected shelter structure on or near the peak and a seam between the rear panel and one of the side panels, the first linking strap arranged to tie to a second linking strap on a second erected shelter structure.

29. The shelter system of claim 25, wherein the at least one shelter structure comprises a first shelter structure constructed from a first multi-functional article and a second shelter structure constructed from a second multi-functional article, with each of the first multi-functional article and the second multi-functional article being capable of being worn as garments, wherein the first multi-functional article has a first peak and the second multi-functional article has a second peak, wherein the cushioned socket of the second peak is arranged to overlay the first peak when the first multi-functional article is assembled adjacent to the second multi-functional article into a linked assembly of shelter structures.

30. The shelter system of claim 25, wherein the multi-functional article is arranged to be worn as a garment, and wherein, when the multi-functional article is worn as the garment:

with the top strap arranged and sized to serve as a belt, with the pair of bottom straps arranged and sized to shorten the side panels, with the rear pocket arranged and sized to serve as a collar, and with the peak arranged to lay flat on an interior surface of the garment.

* * * * *